US011239617B2

(12) United States Patent
Henry et al.

(10) Patent No.: US 11,239,617 B2
(45) Date of Patent: Feb. 1, 2022

(54) CABLE RECEPTACLE CONNECTOR

(71) Applicants: TE Connectivity Services GmbH, Schaffhausen (CH); Tyco Electronics (Shanghai) Co., Ltd., Shanghai (CN)

(72) Inventors: Randall Robert Henry, Lebanon, PA (US); Michael John Phillips, Camp Hill, PA (US); Brandon Michael Matthews, McAlisterville, PA (US); Julia Anne Lachman, York, PA (US); Xinjie Zhang, Shanghai (CN)

(73) Assignees: TE CONNECTIVITY SERVICES GmbH, Schaffhausen (CH); TYCO ELECTRONICS (SHANGHAI) CO. LTD., Shanghai (CN)

( * ) Notice: Subject to any disclaimer, the term of this patent is extended or adjusted under 35 U.S.C. 154(b) by 0 days.

(21) Appl. No.: 16/877,996

(22) Filed: May 19, 2020

(65) Prior Publication Data

US 2021/0313748 A1 Oct. 7, 2021

(51) Int. Cl.

| | |
|---|---|
| ***H01R 24/60*** | (2011.01) |
| ***H01R 13/642*** | (2006.01) |
| ***H01R 13/502*** | (2006.01) |

(52) U.S. Cl.

CPC ..... *H01R 24/60* (2013.01); *H01R 13/502* (2013.01); *H01R 13/642* (2013.01)

(58) Field of Classification Search

CPC ..... H01R 24/60; H01R 13/502; H01R 13/642
USPC ..... 439/633
See application file for complete search history.

(56) References Cited

U.S. PATENT DOCUMENTS

| | | | | |
|---|---|---|---|---|
| 4,367,005 A * | 1/1983 | Douty | H01R 13/582 | 439/357 |
| 4,615,578 A * | 10/1986 | Stadler | H01R 12/775 | 439/607.47 |
| 6,793,508 B2 * | 9/2004 | Chang | H01R 4/66 | 439/189 |
| 6,893,295 B1 * | 5/2005 | Lloyd | H01R 12/772 | 439/607.05 |
| 7,906,730 B2 * | 3/2011 | Atkinson | H01R 13/6474 | 174/78 |
| 8,251,735 B2 * | 8/2012 | Wu | H01R 13/5825 | 439/353 |
| 8,342,886 B2 * | 1/2013 | Zhang | H01R 12/7005 | 439/660 |
| 8,353,726 B2 * | 1/2013 | Zhang | H01R 13/659 | 439/629 |

(Continued)

*Primary Examiner* — Alexander Gilman

(57) ABSTRACT

A contact assembly includes a signal leadframe including signal contacts each extending between a mating end and a terminating end and a ground leadframe separate and discrete from the signal leadframe including ground contacts each extending between a mating end and a terminating end. Each ground contact includes a central transition section between the mating end and the terminating end and a ground tie bar extending between each of the central transition sections and extending across the signal contacts. The contact assembly includes a front contact holder holding the signal contacts of the signal leadframe and holding the ground contacts of the ground leadframe. The front contact holder surrounds the central transition sections of the ground contacts and electrically isolates the ground tie bar from the signal contacts.

23 Claims, 13 Drawing Sheets

(56) References Cited

U.S. PATENT DOCUMENTS 8,523,583 B2 * 9/2013 Ito ..... H01R 12/721 439/108
8,702,451 B2 * 4/2014 Luo ..... H01R 12/725 439/607.28
8,784,122 B2 * 7/2014 Soubh ..... H01R 13/6275 439/79
9,401,570 B2 * 7/2016 Phillips ..... H01R 13/6583
9,502,814 B2 * 11/2016 Furukawa ..... H01R 13/518
9,577,370 B2 * 2/2017 Lin ..... H01R 13/6596
9,692,183 B2 * 6/2017 Phillips ..... H01R 13/6471
9,768,557 B2 * 9/2017 Phillips ..... H01R 13/405
10,128,620 B1 * 11/2018 Wu ..... H01R 13/41
10,135,197 B2 * 11/2018 Little ..... H01R 13/6585
10,367,280 B2 * 7/2019 Lloyd ..... H01R 24/22
10,367,308 B2 * 7/2019 Little ..... H01R 13/6471
10,381,783 B2 * 8/2019 Zhou ..... H01R 12/79
10,535,956 B2 * 1/2020 Henry ..... H01R 13/424
10,574,000 B1 * 2/2020 McClinton ..... H01R 13/6471
10,720,738 B1 * 7/2020 Wu ..... H01R 13/405
10,741,963 B2 * 8/2020 Leigh ..... H01R 13/5804
10,833,437 B2 * 11/2020 Huang ..... H01R 12/716
10,873,160 B2 * 12/2020 Henry ..... H01R 13/6586
2004/0229510 A1 * 11/2004 Lloyd ..... H01R 13/6593 439/607.01
2009/0176400 A1 * 7/2009 Davis ..... H01R 13/506 439/352
2011/0300735 A1 * 12/2011 Wu ..... H01R 13/6658 439/345
2011/0306228 A1 * 12/2011 Wu ..... H01R 13/5825 439/345
2012/0040552 A1 * 2/2012 Wu ..... H01R 13/6581 439/358
2012/0064779 A1 * 3/2012 Wu ..... H01R 13/6471 439/676
2012/0129396 A1 * 5/2012 Wang ..... H01R 12/515 439/607.01
2012/0156938 A1 * 6/2012 Zhang ..... H01R 24/60 439/660
2012/0214345 A1 * 8/2012 Wu ..... H01R 13/6583 439/607.19
2013/0095676 A1 * 4/2013 Wu ..... H01R 24/60 439/76.1
2013/0203293 A1 * 8/2013 Zhu ..... H01R 24/60 439/620.22
2016/0064873 A1 * 3/2016 Bucher ..... H01R 13/6658 385/88

* cited by examiner

CABLE RECEPTACLE CONNECTOR

CROSS REFERENCE TO RELATED APPLICATIONS

This application claims benefit to Chinese Application No. 202010255513.2, filed 2 Apr. 2020, the subject matter of which is herein incorporated by reference in its entirety.

BACKGROUND OF THE INVENTION

The subject matter herein relates generally to electrical connectors.

Electrical connectors are used in communication systems to transmit data signals between various components. Some known communication systems utilize cable systems and cable connectors provided at ends of cables to electrically connect various components. The cables are terminated to ends of contacts, which are mated with mating electrical connectors. Some known cable connectors include a card slot for receiving a circuit card to make an electrical connection there with. However, as data speeds increase and contact density increases, electrical performance and signal integrity is difficult to control in a cost effective and reliable manner.

A need remains for a reliable and cost effective cable receptacle connector.

BRIEF DESCRIPTION OF THE INVENTION

In one embodiment, a contact assembly is provided. The contact assembly includes a signal leadframe including a plurality of signal contacts. Each signal contact extends between a mating end and a terminating end. The mating end is configured to be mated with a mating signal contact. The terminating end is configured to be electrically connected to a cable. The contact assembly includes a ground leadframe separate and discrete from the signal leadframe. The ground leadframe includes a plurality of ground contacts. Each ground contact extends between a mating end and a terminating end. The mating end is configured to be mated with a mating ground contact. The terminating end is configured to be electrically connected to a cable. Each ground contact includes a central transition section between the mating end and the terminating end. The central transition section is remote from the mating end and is remote from the terminating end. The ground leadframe includes a ground tie bar extending between each of the central transition sections to electrically connect each of the ground contacts at each of the central transition sections. The ground tie bar extends across the signal contacts. The contact assembly includes a front contact holder holding the signal contacts of the signal leadframe and holding the ground contacts of the ground leadframe. The front contact holder surrounds the central transition sections of the ground contacts. The front contact holder electrically isolates the ground tie bar from the signal contacts.

In another embodiment, a cable receptacle connector is provided. The cable receptacle connector includes a receptacle housing extending between a front and a rear. The receptacle housing has a mating receptacle at the front configured to receive a mating connector. The receptacle housing includes a rear cavity at the rear. The receptacle housing includes a base wall between the front and the rear having contact channels. The contact channels are open to the mating receptacle. The cable receptacle connector includes a contact assembly received in the receptacle housing. The contact assembly includes an upper contact sub-assembly and a lower contact sub-assembly coupled to the upper contact sub-assembly. The contact assembly includes upper cables electrically connected to the upper contact sub-assembly and lower cables electrically connected to the lower contact sub-assembly. The upper contact sub-assembly comprises an upper signal leadframe, an upper ground leadframe and an upper contact holder. The upper signal leadframe includes a plurality of upper signal contacts each extending between a mating end configured to be mated with an upper mating signal contact of the mating connector and a terminating end electrically connected to the corresponding upper cable. The upper ground leadframe includes a plurality of upper ground contacts each extending between a mating end configured to be mated with an upper mating ground contact of the mating connector and a terminating end electrically connected to the corresponding upper cable. Each upper ground contact includes a central transition section approximately centered between the mating end and the terminating end. The upper ground leadframe includes an upper ground tie bar extending between each of the central transition sections to electrically connect each of the upper ground contacts. The upper contact holder holds the upper signal contacts and the upper ground contacts. The upper contact holder surrounds the central transition section of the upper ground contacts and electrically isolates the upper ground tie bar from the upper signal contacts. The lower contact sub-assembly comprises a lower signal leadframe, a lower ground leadframe and an upper contact holder. The lower signal leadframe includes a plurality of lower signal contacts each extending between a mating end configured to be mated with a lower mating signal contact of the mating connector and a terminating end electrically connected to the corresponding lower cable. The lower ground leadframe includes a plurality of lower ground contacts each extending between a mating end configured to be mated with a lower mating ground contact of the mating connector and a terminating end electrically connected to the corresponding lower cable. Each lower ground contact includes a central transition section approximately centered between the mating end and the terminating end. The lower ground leadframe includes a lower ground tie bar extending between each of the central transition sections to electrically connect each of the lower ground contacts. The upper contact holder holds the lower signal contacts and the lower ground contacts. The upper contact holder surrounds the central transition sections of the lower ground contacts and electrically isolates the lower ground tie bar from the lower signal contacts. The upper contact holder is coupled to the upper contact holder to position the lower signal contacts and the lower ground contacts relative to the upper signal contacts and the upper ground contacts.

In a further embodiment, a cable receptacle connector is provided. The cable receptacle connector includes a shroud having a chamber. The shroud extends between a front and a rear. The shroud has a right side and a left side between the front and the rear. The cable receptacle connector includes a receptacle assembly received in the chamber of the shroud. The receptacle assembly includes a right side sub-assembly in the chamber at the right side of the shroud and a left side sub-assembly in the chamber at the left side of the shroud. The right side sub-assembly includes a first receptacle housing and a first contact assembly received in the first receptacle housing. The first receptacle housing has a first mating receptacle at a front and a first base wall rearward of the first mating receptacle having first contact channels open to the first mating receptacle. The right side sub-assembly includes first cables electrically connected to the first contact assembly. The first contact assembly includes a first signal leadframe, a first ground leadframe and a first contact holder coupled to the first signal leadframe and the first ground leadframe. The first signal leadframe includes a plurality of first signal contacts each extending between a mating end and a terminating end electrically connected to the corresponding first cable. The first ground leadframe includes a plurality of first ground contacts each extending between a mating end and a terminating end. The first ground leadframe includes a first ground tie bar extending between each of the first ground contacts. The first contact holder holds the first signal contacts and the first ground contacts. The left side sub-assembly includes a second receptacle housing and a second contact assembly received in the second receptacle housing. The second receptacle housing has a second mating receptacle at a front and a second base wall rearward of the second mating receptacle having second contact channels open to the second mating receptacle. The left side subassembly includes second cables electrically connected to the second contact assembly. The second contact assembly includes a second signal leadframe, a second ground leadframe and a second contact holder coupled to the second signal leadframe and the second ground leadframe. The second signal leadframe includes a plurality of second signal contacts each extending between a mating end and a terminating end electrically connected to the corresponding second cable. The second ground leadframe includes a plurality of second ground contacts each extending between a mating end and a terminating end. The second ground leadframe includes a second ground tie bar extending between each of the second ground contacts. The second contact holder holds the second signal contacts and the second ground contacts. The first receptacle housing includes an inner end and an outer end opposite the inner end. The outer end includes a keying tab extending therefrom configured to engage the right side of the shroud to locate the first receptacle housing in the chamber. The second receptacle housing includes an inner end and an outer end opposite the inner end. The outer end includes a keying tab extending therefrom configured to engage the left side of the shroud to locate the second receptacle housing in the chamber.

DETAILED DESCRIPTION OF THE INVENTION

Figure 1:
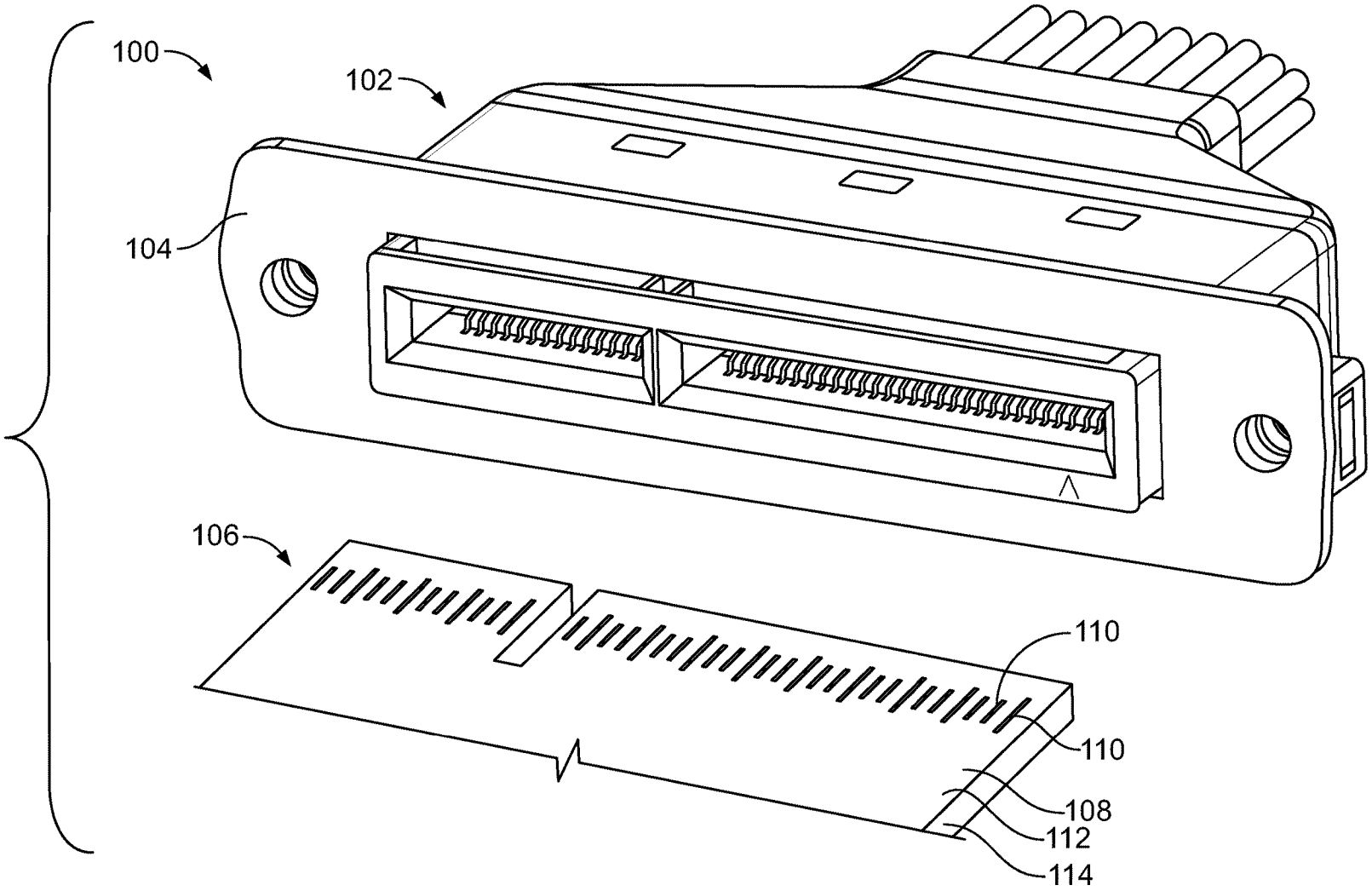
FIG. 1 is a front perspective view of a communication system including a cable receptacle connector in accordance with an exemplary embodiment.

FIG. 1 is a front perspective view of a communication system 100 including a cable receptacle connector 102 in accordance with an exemplary embodiment. The cable receptacle connector 102 is mounted to a panel 104 in the illustrated embodiment. The communication system 100 includes a mating electrical connector 106 configured to be mated with the cable receptacle connector 102. In an exemplary embodiment, the mating electrical connector 106 includes one or more circuit cards 108 configured to be plugged into the cabled receptacle connector 102. For example, an edge of the circuit card 108 may be plugged into the cabled receptacle connector 102. The circuit card 108 may include contacts 110 on an upper surface 112 and/or a lower surface 114 of the circuit card 108. The contacts 110 may be pads, traces, or other circuit conductors of the circuit card 108. Other types of mating electrical connectors may be provided in alternative embodiments other than the circuit card 108.

Figure 2:
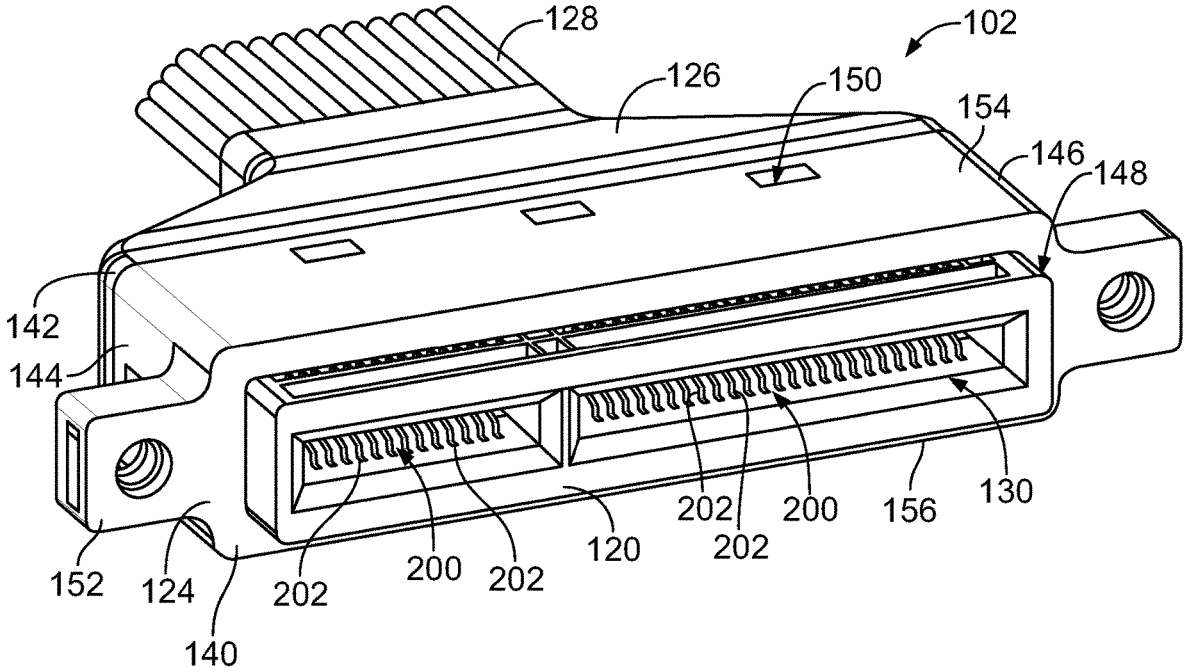
FIG. 2 is a front perspective view of the cable receptacle connector in accordance with an exemplary embodiment.
Figure 3:
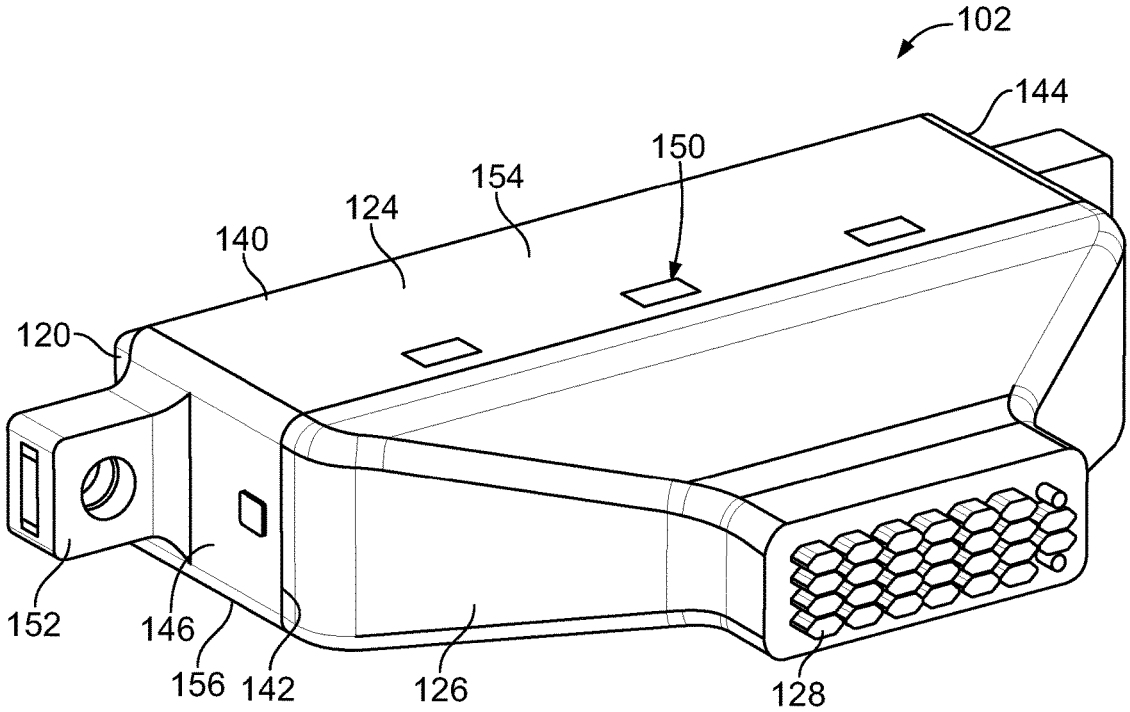
FIG. 3 is a rear perspective view of the cable receptacle connector in accordance with an exemplary embodiment.

FIG. 2 is a front perspective view of the cable receptacle connector 102 in accordance with an exemplary embodiment. FIG. 3 is a rear perspective view of the cable receptacle connector 102 in accordance with an exemplary embodiment. The cable receptacle connector 102 includes one or more receptacle housings 120 holding one or more contact assemblies 200. In an exemplary embodiment, the cabled receptacle connector 102 includes a shroud 124 holding the one or more receptacle housings 120 and a strain relief 126 coupled to the rear of the shroud 124.

The strain relief 126 provides strain relief for cables 128 extending from the cabled receptacle connector 102. The strain relief 126 may gather and locate the cables 128 relative to each other. In an exemplary embodiment, the strain relief 126 is overmolded around the cables 128 and formed in situ on the shroud 124. Alternatively, the strain relief 126 may be separately manufactured, such as by a molding process, and coupled to the rear of the shroud 124.

The shroud 124 extends between a front 140 and a rear 142. The shroud 124 has a right side 144 and a left side 146. The shroud 124 forms a chamber 148 that receives the receptacle housing 120. The chamber 148 is open at the front 140 and the rear 142 in the illustrated embodiment. In an exemplary embodiment, the receptacle housing 120 may be rear loaded into the chamber 148 through the rear 142. The strain relief 126 extends from the rear 142. In an exemplary embodiment, a portion of the receptacle housing 120 extends forward of the front 140. For example, a portion of the receptacle housing 120 may be configured to extend from the shroud 124 through the panel 104 (shown in FIG. 1). In an exemplary embodiment, the shroud 124 includes openings 150. The strain relief 126 may be coupled to the shroud 124 at the openings 150. For example, the plastic material of the strain relief 126 may be injected into the shroud 124 and into the openings 150 of the shroud 124 to secure the strain relief 126 to the shroud 124. The openings may be provided proximate to the rear 142. The openings 150 may be provided at the right side 144, at the left side 146, at a top 154 and/or at a bottom 156 of the shroud 124. In an exemplary embodiment, the shroud 124 includes mounting tabs 152 extending from the right side 144 and/or the left side 146 for mounting the cable receptacle connector 102 to the panel 104.

The contact assembly 200 includes a plurality of contacts 202 arranged in the receptacle housing 120 for mating with the mating electrical connector 106. In an exemplary embodiment, the receptacle housing 120 includes a mating receptacle 130 at the front of the receptacle housing 120 that receives the mating electrical connector 106. For example, the mating receptacle 130 may include a card slot configured to receive the edge of the circuit card 108. In an exemplary embodiment, the contacts 202 are arranged in an upper row and a lower row for mating with the contacts 110 on the upper surface 112 and the lower surface 114 of the circuit card 108. For example, the contacts 202 may be arranged in an upper contact sub assembly 204 and a lower contact sub assembly 206. Other arrangements are possible in alternative embodiments.

Figure 4:
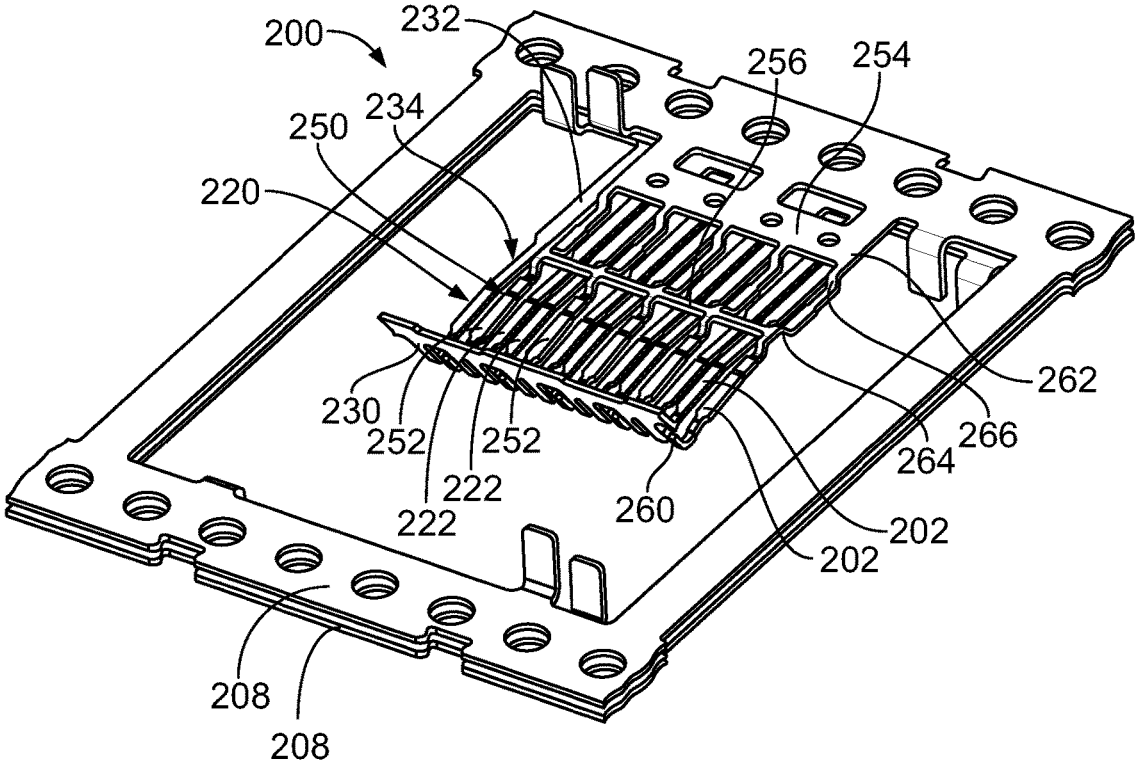
FIG. 4 is a perspective view of a portion of the contact assembly showing a plurality of the contacts in accordance with an exemplary embodiment.

FIG. 4 is a perspective view of a portion of the contact assembly 200 showing a plurality of the contacts 202 In accordance with an exemplary embodiment. The contacts 202 are shown as parts of one or more lead frames with carrier frames 208 that are later removed from the contacts 202 during manufacture. The contacts 202 and the carrier frames 208 are configured to be stamped from a sheet of metal during a manufacturing process. The carrier frames 208 are used to position the contacts 202 relative to each other for other manufacturing steps, such as overmolding.

In an exemplary embodiment, the contact assembly 200 includes a signal lead frame 220 and a ground lead frame 250. The signal lead frame 220 includes a plurality of signal contacts 222. Each signal contact 222 extends between a mating end 230 and a terminating end 232. The mating end 230 is configured to be mated with the corresponding mating signal contact 110 of the circuit card 108 (shown in FIG. 1). The terminating end 232 is configured to be electrically connected to a corresponding cable 128 (shown in FIG. 3). For example, the signal contact 222 may include a solder pad at the terminating end 232 configured to be soldered to a signal conductor of the cable 128. In an exemplary embodiment, each signal contact 222 includes in impedance control section 234 along the length of the signal contact 222. Impedance control section 234 is used to control impedance through the signal contact 222. In the illustrated embodiment, the signal contact 222 is narrower along the impedance control section 234 than other sections of the signal contact 222. The necked down region defining these impedance control section 234 may be encased or enclosed in dielectric material. In an exemplary embodiment, the signal contacts 222 are arranged in pairs, such as configured to convey differential signals.

The ground lead frame 250 includes a plurality of ground contacts 252. A ground bar 254 extends between each of the ground contacts 252 to electrically connect each of the ground contacts 252 together at the rear ends of the ground contacts 252. A ground tie bar 256 extends between each of the ground contacts 252 to electrically connect each of the ground contacts 252 together at Central sections of the ground contacts 252. The ground tie bar 256 is located remote from the ground bar 254. The ground bar 254 and the ground tie bar 256 provide electrical connections between the ground contacts 252 at different sections along the lengths of the ground contacts 252. The ground bar 254 and the ground tie bar 256 are formed integral with the ground contacts 252. For example, the ground bar 254 and the ground tie bar 256 are stamped and formed from the same sheet of metal that is used to form the ground contacts 252. As such, it is not necessary to manufacture separate ground bars or separate ground tie bars. Additionally, it is not necessary to assemble separate ground bars or separate ground tie bars, such as soldering ground bars or ground tie bars to the ground contacts 252.

Each ground contact 252 extends between a mating end 260 and a terminating end 262. The mating end 260 is configured to be mated with the corresponding mating ground contact 110 of the circuit card 108. The terminating end 262 is configured to be electrically connected to a corresponding cable 128. In an exemplary embodiment, the ground bar 254 extends between the terminating ends 262 to electrically connect the terminating ends 262. Optionally, the ground bar 254 may be electrically connected to the cable 128, such as to a drain wire or cable shield of the cable 128.

In an exemplary embodiment, each ground contact 252 includes a central transition section 264 between the mating end 260 and the terminating end 262. The central transition section 264 is remote from the mating end 260 and remote from the terminating end 262. The ground tie bar 256 extends between each of the central transition sections 264 to electrically connect each of the ground contacts 252 at each of the central transition sections 264. In an exemplary embodiment, the central transition sections 264 extend out of plane with respect to other sections of the ground contact 252. For example, the central transition sections 264 may transition upward (or downward) out of the plane of the ground contact 252. The ground tie bar 256 extends across the signal contacts 222 out of the plane of the signal contacts 222. For example, the ground tie bar 256 may be located above (or below) the signal contacts 222. In an exemplary embodiment, the central transition sections 264 may be approximately centered along the lengths of the ground contacts 252. For example, the central transition sections 264 may be centered between the mating ends 260 and the terminating ends 262 of the ground contacts 252. In an exemplary embodiment, the central transition sections 264 and the ground tie bar 256 are axially aligned with the impedance control sections 234 of the signal contacts 222 along the lengths of the signal contacts 222 and the ground contacts 252.

In an exemplary embodiment, each ground contact 252 includes a rear transition section 266 at the terminating end 262. The ground bar 254 extends between each of the rear transition sections 266. In an exemplary embodiment, the rear transition sections 266 extend out of plane with respect to other sections of the ground contact 252. For example, the rear transition sections 266 may transition upward (or downward) out of the plane of the ground contact 252. The rear transition sections 266 may be transitioned in the same direction as the central transition sections 264. The ground bar 254 extends across the signal contacts 222 out of the plane of the signal contacts 222. For example, the ground bar 254 may be located above (or below) the signal contacts 222.

Figure 5:
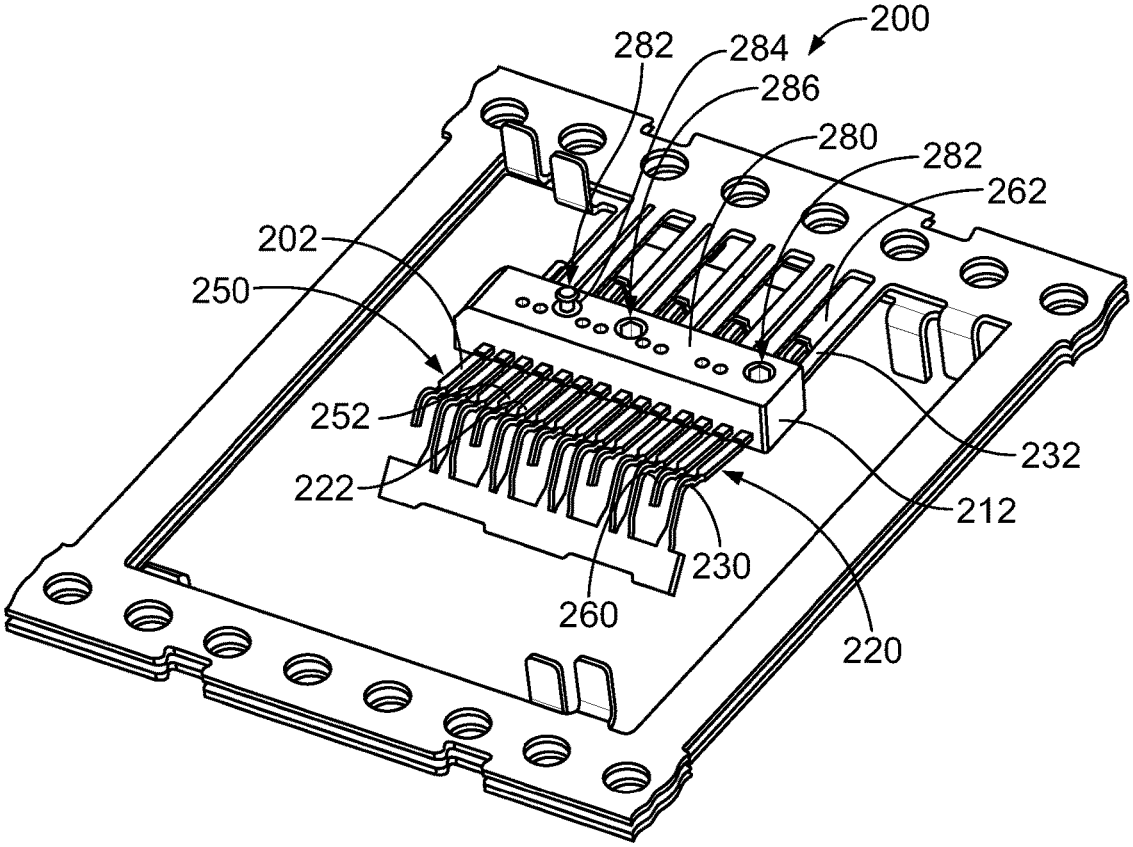
FIG. 5 is a perspective view of a portion of the contact assembly showing a front contact holder coupled to the contacts in accordance with an exemplary embodiment.

FIG. 5 is a perspective view of a portion of the contact assembly 200 showing a front contact holder 212 coupled to the contacts 202 (for example, both the signal contacts 222 and the ground contacts 252). The front contact holder 212 is used to hold the relative positions of the signal contacts 222 and the ground contacts 252.

In an exemplary embodiment, the front contact holder 212 includes a dielectric body 280 coupled to the contacts 202. In an exemplary embodiment, the dielectric body 280 is overmolded over the signal lead frame 220 and the ground lead frame 250. The dielectric body 280 is overmolded to encase portions of the signal contacts 222 and the ground contacts 252. In alternative embodiments, the contacts 202 may be stitched into the dielectric body 280. The front contact holder 212 includes securing features 282 for securing the front contact holder 212 to another component, such as to another contact holder. In the illustrated embodiment, the securing features 282 include posts 284 and openings 286. Other types of securing features 282 may be provided in alternative embodiments, such as latches, securing hardware, or other features.

In an exemplary embodiment, the front contact holder 212 is approximately centered along the lengths of the contacts 202. For example, the front contact holder 212 may be approximately equidistant from the mating ends 230, 260 and the terminating ends 232, 262 of the signal contacts 222 and the ground contacts 252. The front contact holder 212 is coupled to the central transition sections 264 (shown in FIG. 4) in an exemplary embodiment. For example, the central transition sections 264 may be encased in the dielectric body 280. The ground tie bar 256 (shown in FIG. 4) may be encased in the dielectric body 280. In an exemplary embodiment, the impedance control sections 234 (shown in FIG. 4) are encased in the dielectric body 280. The impedance control sections 234 provide impedance control along the signal lines of the signal contacts 222 where the signal contacts 222 are surrounded by the plastic material of the dielectric body 280 as opposed to being surrounded by air. For example, the impedance control sections 234 are narrower through the dielectric body 280 to lower the impedance through the dielectric body 280.

Figure 6:
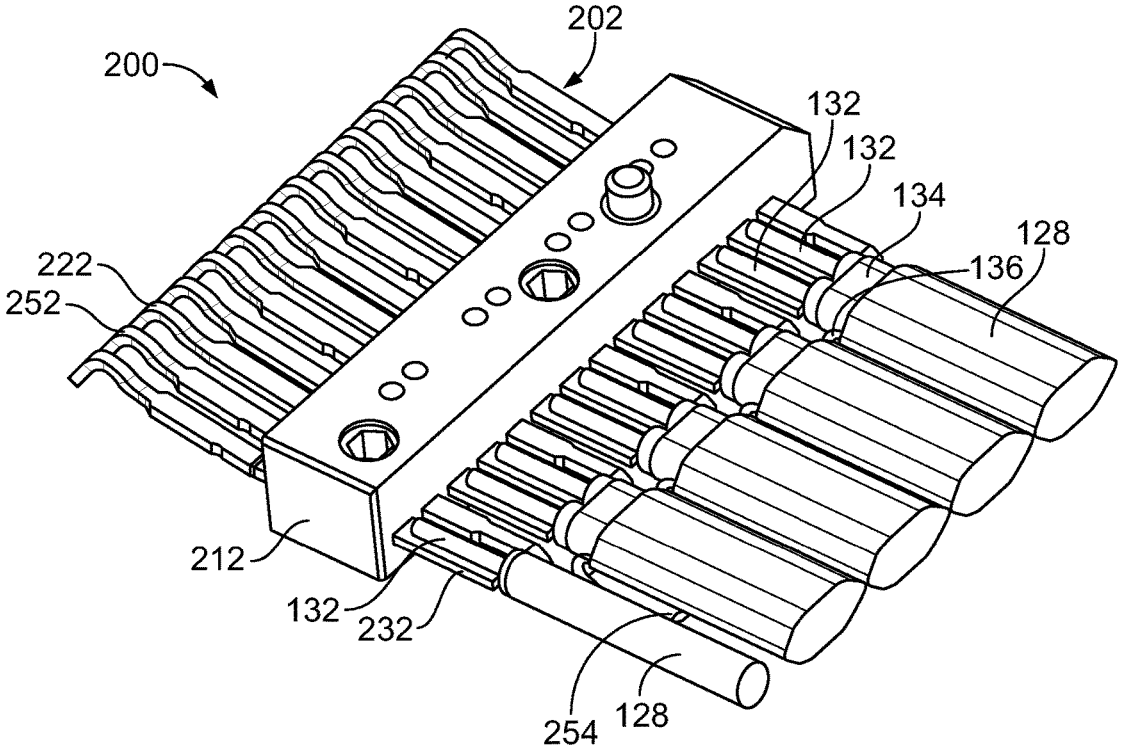
FIG. 6 is a perspective view of a portion of the contact assembly with the carrier frames removed in accordance with an exemplary embodiment.
Figure 7:
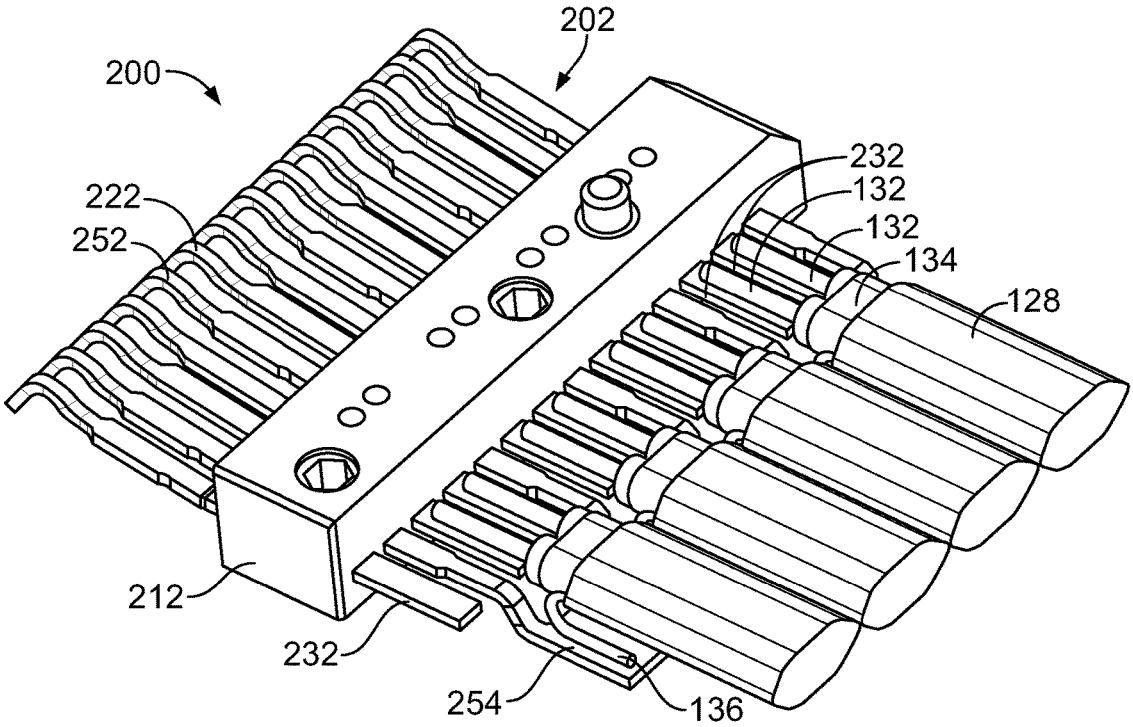
FIG. 7 is a perspective view of a portion of the contact assembly showing one of the cables removed to illustrate portions of the contact assembly in accordance with an exemplary embodiment.

FIG. 6 is a perspective view of a portion of the contact assembly 200 with the carrier frames 208 (shown in FIGS. 4 and 5) removed. FIG. 7 is a perspective view of a portion of the contact assembly 200 showing one of the cables 128 removed to illustrate portions of the contact assembly 200. The front contact holder 212 is coupled to the signal contacts 222 and the ground contacts 252. The cables 128 are electrically connected to the signal contacts 222 and the ground contacts 252. The ground contacts 252 are interspersed between corresponding signal contact 222. In an exemplary embodiment, a subset of the signal contacts 222 are arranged in pairs, such as for conveying high speed signals in another subset of the signal contacts 222 include single signal contacts 222, such as for conveying low speed signals or other types of signals. In the illustrated embodiment, the ground contacts 252 are arranged between the pairs of signal contacts 222. In other various embodiments, a subset of the contacts 202 may be power contacts configured to convey power through the contact assembly 200.

In an exemplary embodiment, various cables 128 may be twin-axial cables including a pair of signal conductors 132. The signal conductors 132 are electrically connected to the terminating ends 232 of the signal contacts 222. In various embodiments, the signal conductors 132 are soldered to the terminating ends 232. Other types of terminating ends may be provided in alternative embodiments, such as a crimp barrels or installation displacement contacts. In an exemplary embodiment, the cables 128 include cable braids 134 for providing electrical shielding for the signal conductors 132. The cables 128 may include drain wires 136 the ground contacts 252 are electrically connected to the cable braids 134 and/or the drain wires 136. For example, the drain wires 136 and/or the cable braids 134 may be soldered to the ground bar 254.

Figure 8:
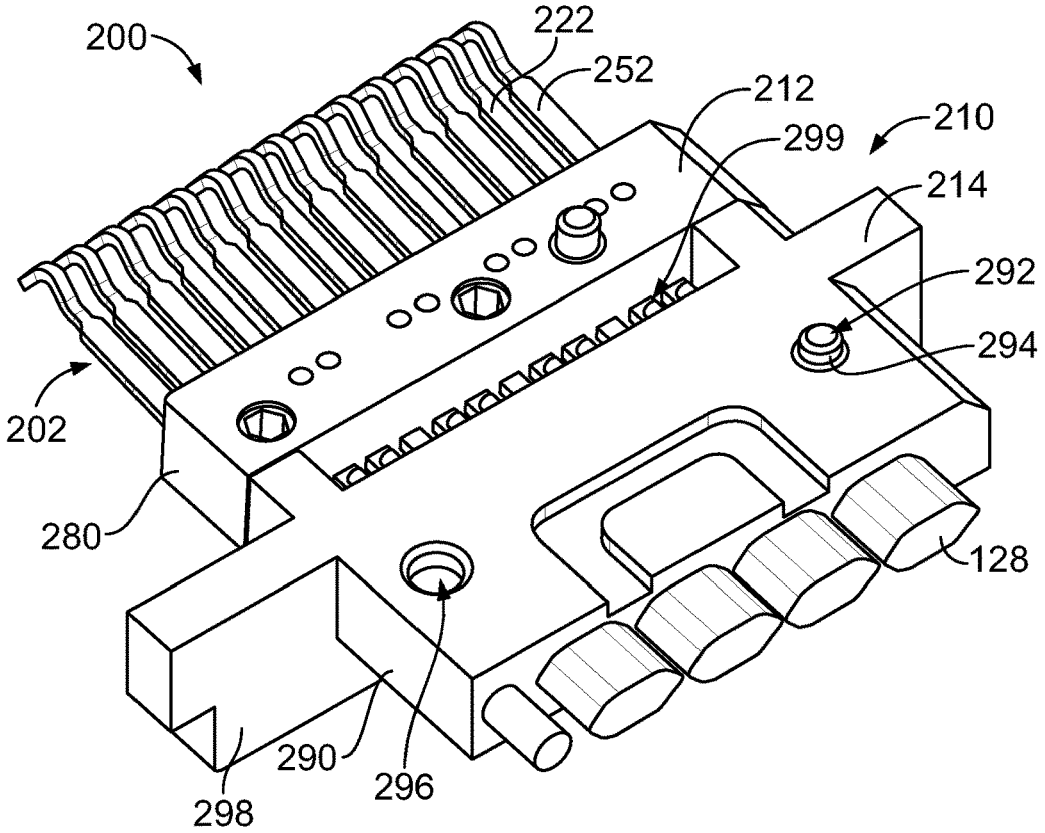
FIG. 8 is a rear perspective view of the contact assembly showing a rear contact holder coupled to the contacts.
Figure 9:
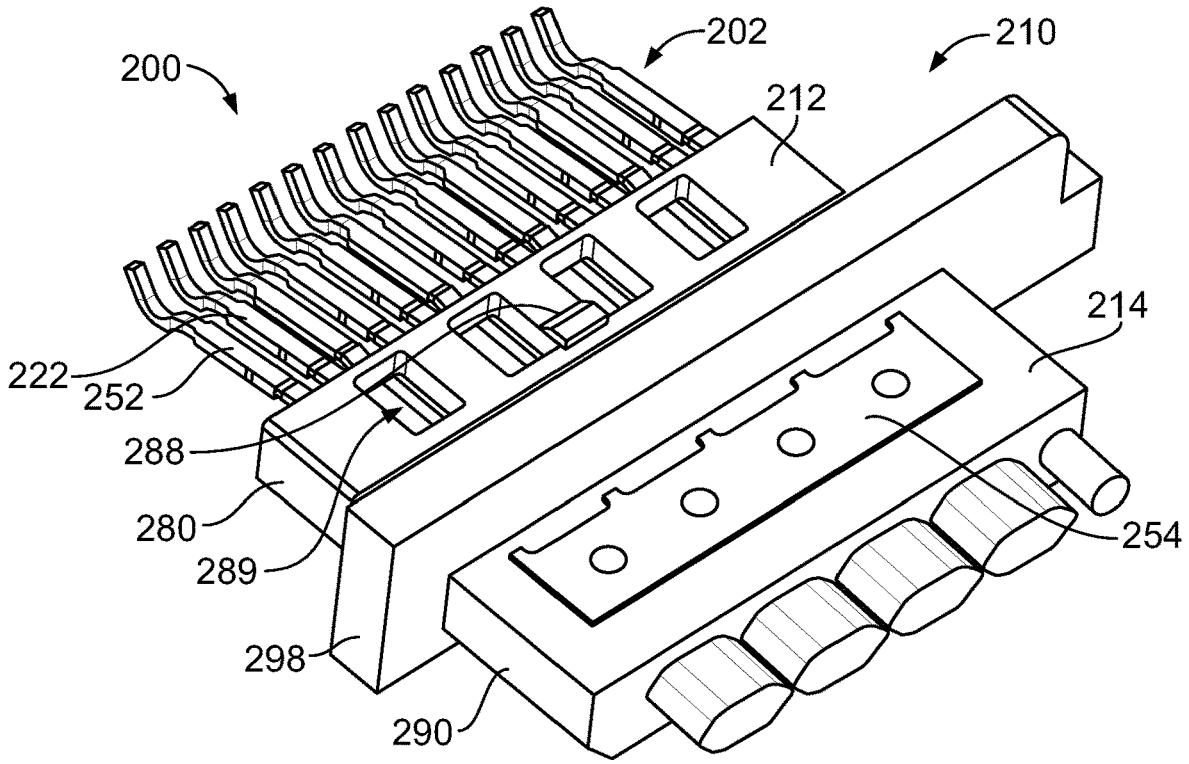
FIG. 9 is a rear perspective view of the contact assembly showing a contact holder holding the contacts.

FIG. 8 is a rear perspective view of the contact assembly 200 showing a rear contact holder 214 coupled to the contacts 202 (for example, both the signal contacts 222 and the ground contacts 252). FIG. 9 is a rear perspective view of the contact assembly 200 showing a contact holder 210 holding the contacts 202. The contact holder 210, in the illustrated embodiment, is a multipiece contact holder including the front contact holder 212 and the rear contact holder 214. The front contact holder 212 is used to initially hold and position the contacts 202 relative to each other for termination of the cables 128 to the contacts 202. After the cables 128 are assembled, the rear contact holder 214 is provided to provide additional support for the contacts 202 and/or to provide strain relief for the cables 128.

In an exemplary embodiment, the rear contact holder 214 includes a dielectric body 290 coupled to the contacts 202 and the cables 128. In an exemplary embodiment, the dielectric body 290 is overmolded over the signal lead frame 220, the ground lead frame 250, and the cables 128. The dielectric body 290 is overmolded to encase portions of the contacts 202 and the cables 128. The rear contact holder 214 includes securing features 292 for securing the rear contact holder 214 to another component, such as to another contact holder. In the illustrated embodiment, the securing features 292 include posts 294 and openings 296. Other types of securing features 292 may be provided in alternative embodiments, such as latches, securing hardware, or other features.

In an exemplary embodiment, the rear contact holder 214 is provided at the rear end of the contact assembly 200. The rear contact holder 214 is coupled to the terminating ends 232, 262 of the signal contacts 222 and the ground contacts 252. The rear contact holder 214 may encase the ground bar 254 (FIG. 9). The dielectric body 290 extends rearward of the contact assembly 200 along portions of the cables 128. The rear contact holder 214 holds relative positions of the cables 128 and provides strain relief for the cables 128.

In an exemplary embodiment, the rear contact holder 214 includes a flange 298 extending therefrom. The flange 298 is used for positioning the contact assembly 200 relative to the receptacle housing 120 (shown in FIG. 1). The flange 298 may extend from the sides and/or the ends (for example, the top end and/or the bottom end) of the dielectric body 280.

In an exemplary embodiment, the rear contact holder 214 includes one or more pockets 299 (FIG. 8) exposing portions of the contacts 202. For example, in the illustrated embodiment, the terminating ends 232 of the signal contacts 222 and the signal conductors 132 of the cables 128 are exposed in the pocket 299. The pocket 299 is filled with air to provide impedance control along the signal lines. For example, the pocket 299 defines a void to raise the impedance along the exposed segments of the signal contacts 222. The size and shape of the pocket 299 may be designed to control the impedance, such as to achieve a target impedance along the signal lines.

In an exemplary embodiment, the front contact holder 212 includes a latching feature 288 extending from the dielectric body 280. The latching feature 288 is used for securing the contact assembly 200 in the receptacle housing 120. Other types of securing features may be used in alternative embodiments.

In an exemplary embodiment, the front contact holder 212 includes one or more pockets 289 (FIG. 9) exposing portions of the contacts 202. For example, in the illustrated embodiment, the impedance control sections 234 of the signal contacts 222 are exposed in the pockets 289. The pockets 289 are filled with air to provide impedance control along the signal lines. For example, the pockets 289 define voids to raise the impedance along the exposed segments of the signal contacts 222. The size and shape of the pockets 289 may be designed to control the impedance, such as to achieve a target impedance along the signal lines.

Figure 10:
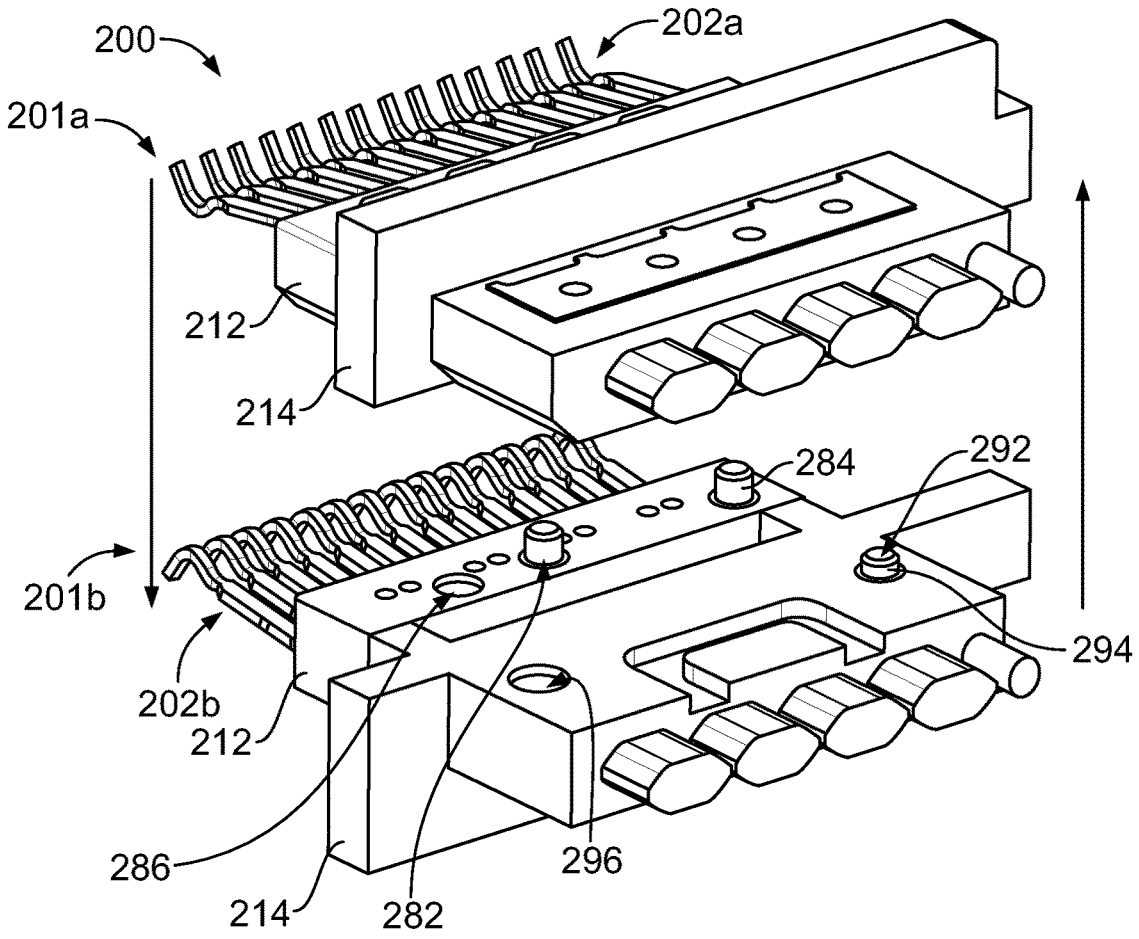
FIG. 10 is a rear perspective view of the contact assembly in accordance with an exemplary embodiment showing an upper contact subassembly and a lower contact subassembly.
Figure 11:
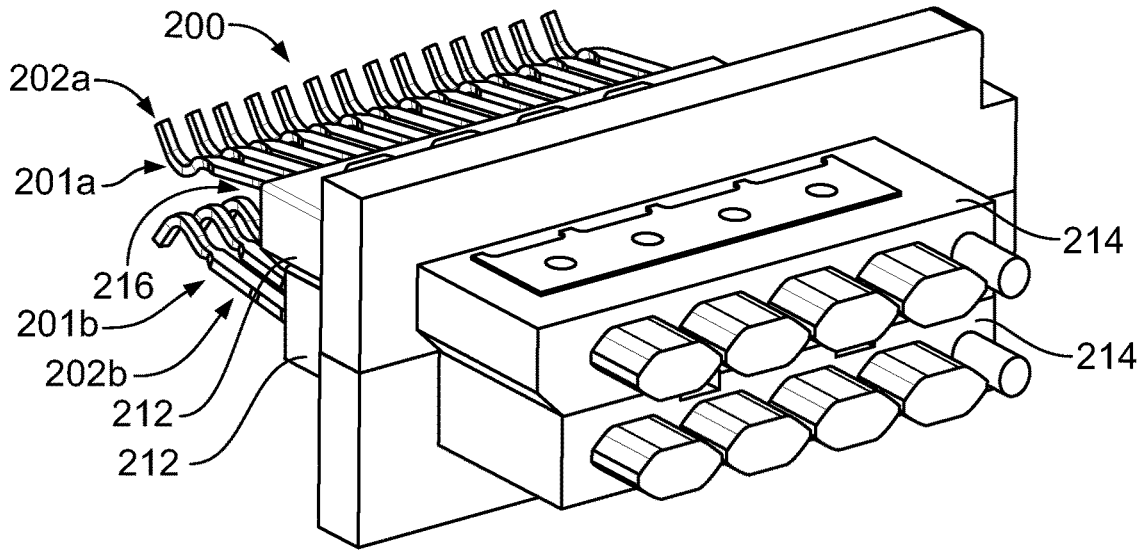
FIG. 11 is a rear perspective view of the contact assembly in accordance with an exemplary embodiment showing the upper contact subassembly and the lower contact subassembly in an assembled state.

FIG. 10 is a rear perspective view of the contact assembly 200 in accordance with an exemplary embodiment showing an upper contact subassembly 201*a* and a lower contact subassembly 201*b*. FIG. 11 is a rear perspective view of the contact assembly 200 in accordance with an exemplary embodiment showing the upper contact subassembly 201*a* and the lower contact subassembly 201*b* in an assembled state. FIG. 10 illustrates the upper contact subassembly 201*a* and the lower contact subassembly 201*b* separated and poised for mating together.

The upper and lower contact assemblies 201*a*, 201*b* may be similar to each other. Various components of the upper contact assembly 201*a* may be referred to using the modifier "upper" and various components of the lower contact assembly 201*b* may be referred to using the modifier "lower". Optionally, the upper and lower contact assemblies 201*a*, 201*b* may be identical to each other. However, in various embodiments, the upper contact assembly 201*a* and/or the lower contact assembly 201*b* may include keying features (which may be different than the other contact assembly) to orient the contact assembly 200 within the receptacle housing 120 (shown in FIG. 1). The upper contact assembly 201*a* is inverted 180° relative to the lower contact assembly 201*b*.

During assembly, the securing features 282 of the front contact holders 212 are coupled together and the securing features 292 of the rear contact holders 214 are coupled together. For example, the posts 284 are received in corresponding openings 286 and the posts 294 are received in corresponding openings 296. The front contact holders 212 may be secured together by an interference fit. The rear contact holders 214 may be secured together by an interference fit. When assembled, the upper contacts 202*a* of the upper contact subassembly 201*a* are arranged in an upper row and the lower contacts 202*b* of the lower contact assembly 201*b* are arranged in a lower row. The upper contacts 202*a* are separated from the lower contacts 202*b* by a contact gap 216. The contact gap 216 is configured to receive the circuit card 108 (shown in FIG. 1).

The contact assembly 200 may include any number of contacts 202. In the illustrated embodiment, the contact assembly 200 is a 28 position contact assembly having 14 upper contacts 202*a* (8 high speed signal contacts arranged in pairs, 5 ground contacts and 1 low speed signal contact) and having 14 lower contacts 202*b* (8 high speed signal contacts arranged in pairs, 5 ground contacts and 1 low speed signal contact). Other arrangements having greater or fewer contacts 202 may be provided in alternative embodiments.

Figure 12:
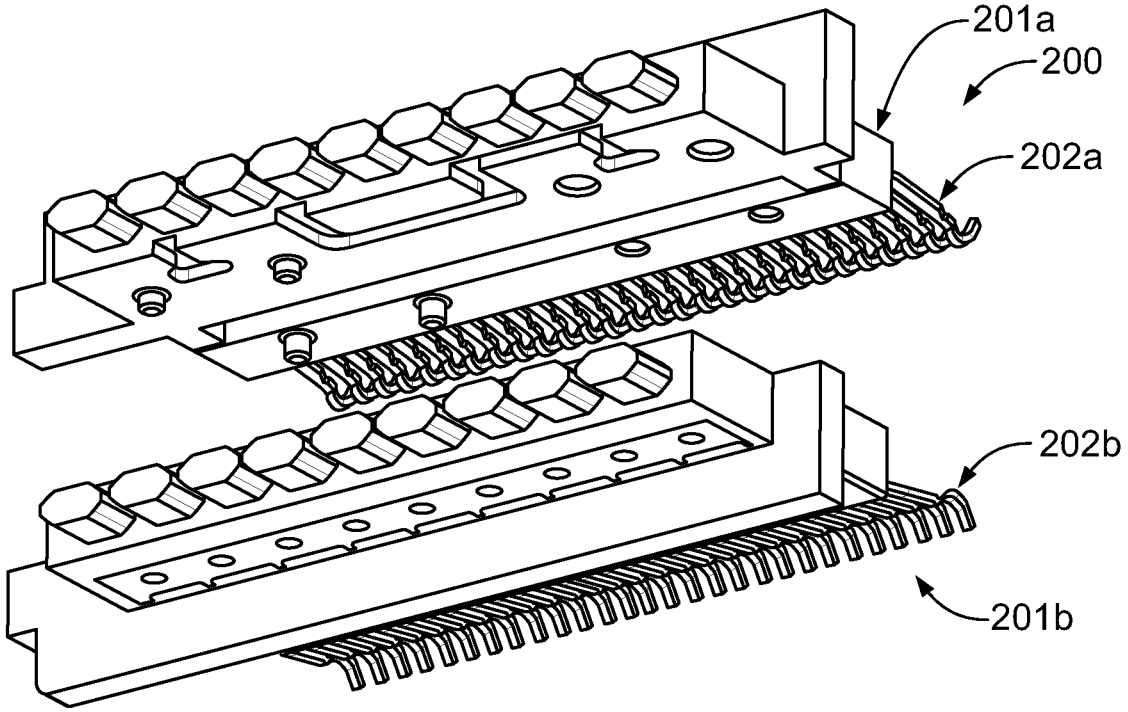
FIG. 12 is a rear perspective view of the contact assembly in accordance with an exemplary embodiment showing the upper contact subassembly and the lower contact subassembly.
Figure 13:
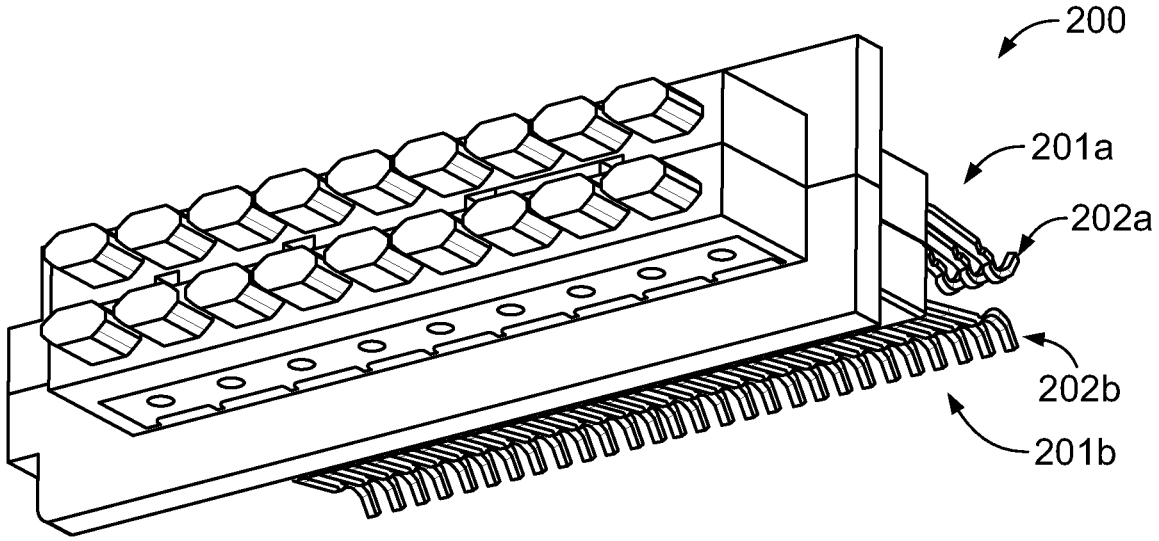
FIG. 13 is a rear perspective view of the contact assembly in accordance with an exemplary embodiment showing the upper contact subassembly and the lower contact subassembly in an assembled state.

FIG. 12 is a rear perspective view of the contact assembly 200 in accordance with an exemplary embodiment showing the upper contact subassembly 201*a* and the lower contact subassembly 201*b*. FIG. 13 is a rear perspective view of the contact assembly 200 in accordance with an exemplary embodiment showing the upper contact subassembly 201*a* and the lower contact subassembly 201*b* in an assembled state. FIGS. 12 and 13 illustrate the contact assembly 200 having a greater amount of the contacts 202 compared to the contact assembly 200 illustrated in FIGS. 10 and 11. In the illustrated embodiment, the contact assembly 200 is a 56 position contact assembly having 28 upper contacts 202*a* (18 high speed signal contacts arranged in pairs, and 10 ground contacts between the pairs of signal contacts) and having 28 lower contacts 202*b* (18 high speed signal contacts arranged in pairs and 10 ground contacts). Other arrangements of the contact 202 are possible in alternative embodiments.

Figure 14:
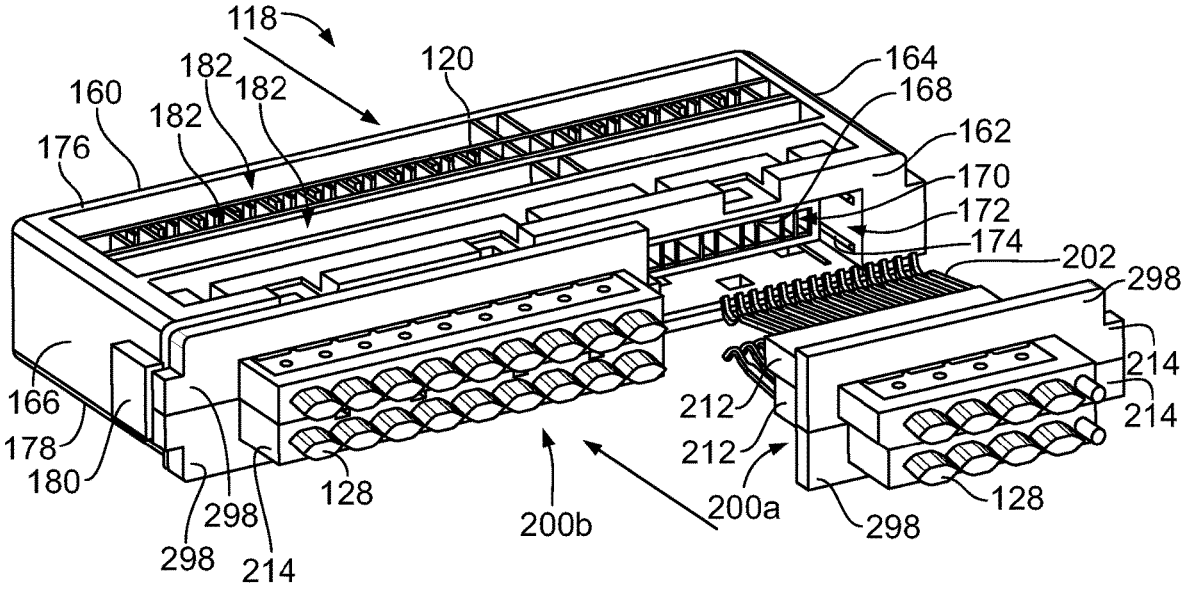
FIG. 14 is a rear perspective view of a receptacle assembly in accordance with an exemplary embodiment.

FIG. 14 is a rear perspective view of a receptacle assembly 118 in accordance with an exemplary embodiment. The receptacle assembly 118 includes the receptacle housing 120 and the contact assemblies 200 configured to be coupled to the receptacle housing 120. In the illustrated embodiment, the receptacle assembly 118 includes two of the contact assemblies 200 configured to be received in the same receptacle housing 120. For example, the receptacle assembly 118 includes a first contact assembly 200*a* and a second contact assembly 200*b*. The receptacle assembly 118 may include greater or fewer contact assemblies 200 in alternative embodiments. Providing additional contact assemblies 200 increases the number of contacts 202 provided in the receptacle assembly 118. The contact assemblies 200*a*, 200*b* may be identical, or alternatively, may be different from each other. In the illustrated embodiment, the first contact assembly 200*a* is a 28 position contact assembly, such as the contact assembly illustrated in FIGS. 10 and 11, whereas the second contact assembly 200*b* is a 56 position contact assembly, such as the contact assembly illustrated in FIGS. 12 and 13. In other various embodiments, the receptacle assembly 118 may include multiple receptacle housings 120 configured to be coupled together to form a unitary receptacle housing. For example, a different receptacle housing 120 may be provided for each of the contact assemblies 200.

The receptacle housing 120 extends between a front 160 and a rear 162. The receptacle housing 120 is a right side 164 and a left side 166. In an exemplary embodiment, the receptacle housing 120 has a base wall 168 spanning across the receptacle housing 120 between the right side 164 and the left side 166. The base wall 168 includes a plurality of contact channels 170 therethrough. The contact channels 170 are configured to receive corresponding contacts 202 of the contact assemblies 200. The base wall 168 is located rearward of the mating receptacle 130 (shown in FIG. 1). In an exemplary embodiment, a rear cavity 172 is located rearward of the base wall 168. The rear cavity 172 receives the contact assemblies 200. For example, the rear cavity 172 may be sized and shaped to receive the front contact holders 212 of the contact assemblies 200. In an exemplary embodiment, the receptacle housing 120 includes crush ribs 174 extending into the rear cavity 172. The crush ribs 174 are configured to engage the front contact holders 212 when the contact assemblies 200 are loaded into the rear cavity 172. The crush ribs 174 are configured to retain the contact assemblies 200 in the rear cavity 172 by an interference fit. When assembled, the flanges 298 of the rear contact holders 214 abut against the rear 162 of the receptacle housing 120. The flanges 298 close off access to the rear cavity 172 and the contact channels 170. For example, the flanges 298 prevent ingress of the molded plastic material forming the strain relief 126 (shown in FIG. 1) from entering the rear cavity 172 and the contact channels 170 during manufacture of the strain relief 126 around the cables 128.

In an exemplary embodiment, the receptacle housing 120 includes a top 176 and a bottom 178. In an exemplary embodiment, the receptacle housing 120 includes locating tabs 180 extending therefrom for locating the receptacle housing 120 within the shroud 124 (shown in FIG. 15). In the illustrated embodiment, the locating tabs 180 are provided at the right side 164 and the left side 166. Other locations are possible in alternative embodiments. In an exemplary embodiment, the receptacle housing 120 includes pockets 182 in the top 176 and the bottom 178. The pockets 182 are used for impedance control. The pockets 182 to define air voids for impedance control. For example, the pockets 182 expose sections of the contacts 202 to air for impedance control.

Figure 15:
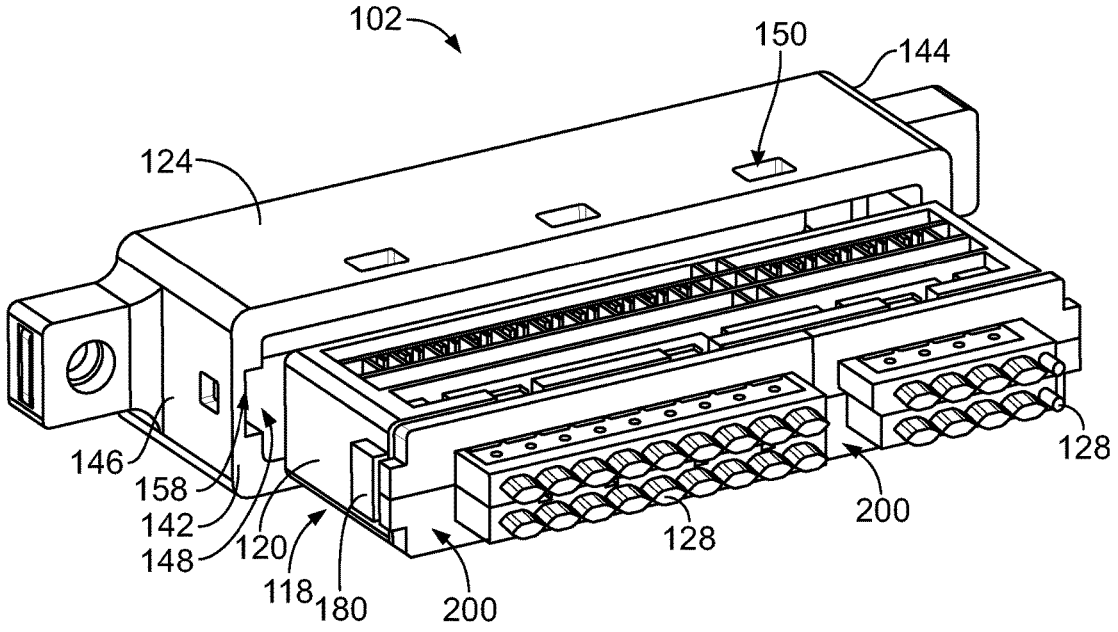
FIG. 15 is a rear perspective view of the cable receptacle connector in accordance with an exemplary embodiment.
Figure 16:
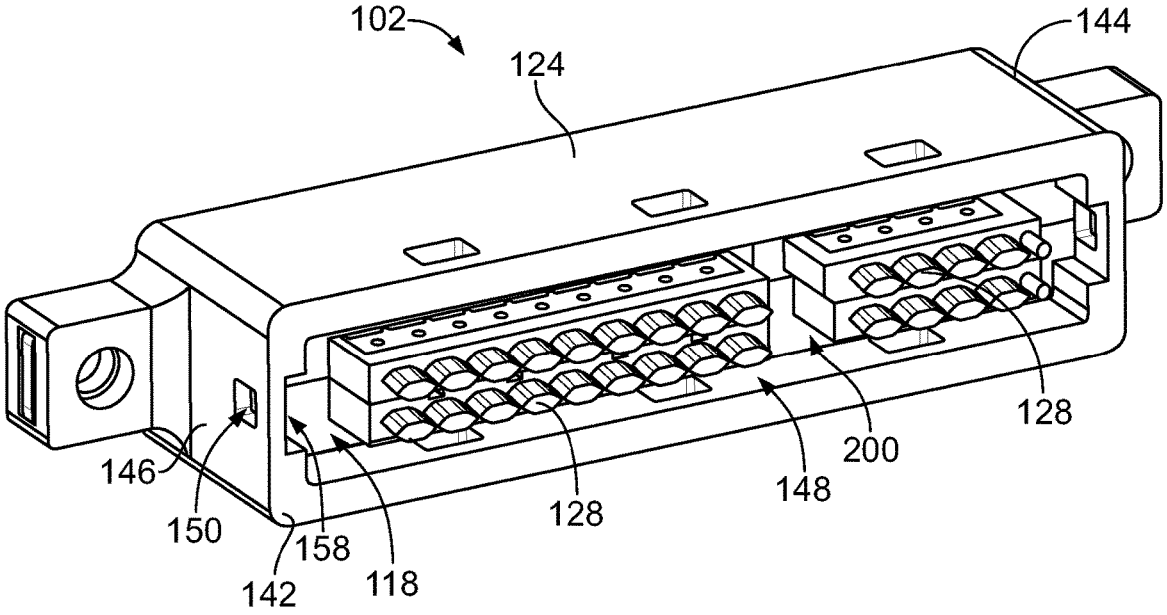
FIG. 16 is a rear perspective view of the cable receptacle connector in accordance with an exemplary embodiment.

FIG. 15 is a rear perspective view of the cable receptacle connector 102 in accordance with an exemplary embodiment. FIG. 16 is a rear perspective view of the cable receptacle connector 102 in accordance with an exemplary embodiment. FIG. 15 illustrates the receptacle assembly 118 poised for loading into the shroud 124. FIG. 16 illustrates the receptacle assembly 118 received in the shroud 124.

The receptacle housing 120 is aligned with the chamber 148 of the shroud 124 at the rear 142 of the shroud 124. The receptacle assembly 118 is rear loaded into the chamber 148. In an exemplary embodiment, the shroud 124 includes guide slots 158 along the right side 144 and the left side 146. The guide slots 158 are open at the rear 142. The guide slots 158 receive the locating tabs 180 of the receptacle housing 120 to position the receptacle housing 120 in the chamber 148. When assembled, the contact assemblies 200 may be completely surrounded by the shroud 124. For example, the contact assemblies 200 may be located within the chamber 148. The cables 128 extend rearward from the shroud 124 and exit the chamber 148. The strain relief 126 (shown in FIG. 1) may be coupled to the shroud 124 to retain the receptacle assembly 118 in the chamber 148 and provide strain relief for the cables 128. For example, the strain relief 126 may be molded in place to the rear 142 of the shroud 124 to retain the receptacle assembly 118 in the shroud 124 and provide strain relief for the cables 128. The strain relief 126 may be molded into the openings 150 in the shroud 124 To lock the strain relief 126 to the shroud 124.

Figure 17:
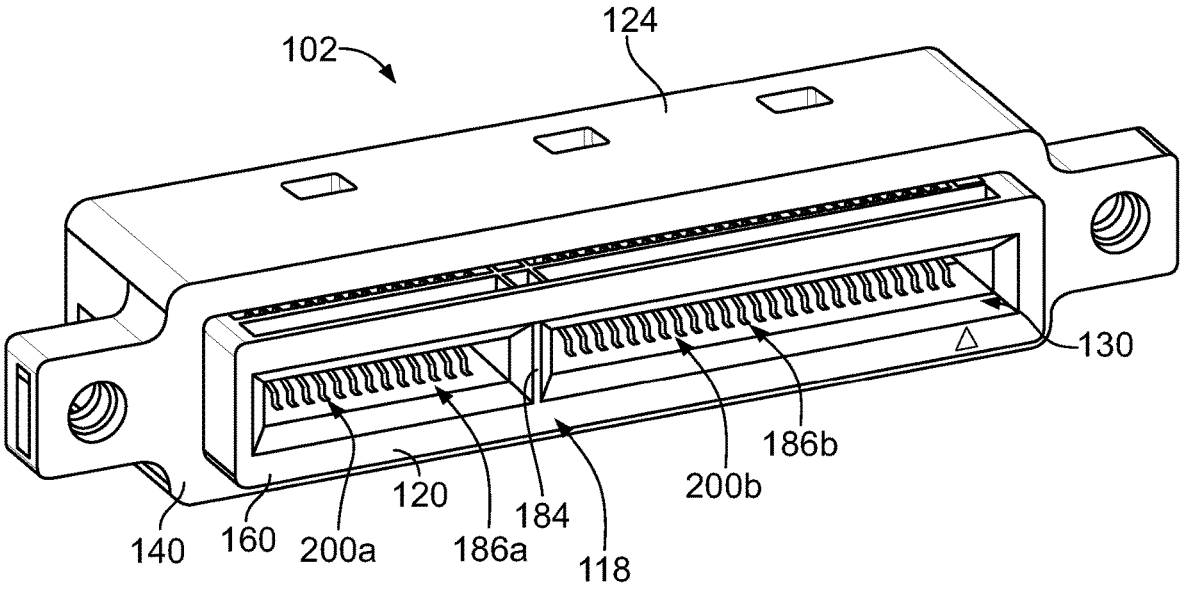
FIG. 17 is a front perspective view of the cable receptacle connector in accordance with an exemplary embodiment.

FIG. 17 is a front perspective view of the cable receptacle connector 102 in accordance with an exemplary embodiment. When assembled, the receptacle assembly 118 may extend from the front 140 of the shroud 124. For example, a portion of the receptacle housing 120 may protrude forward of the front 140 of the shroud 124. The mating receptacle 130 is open at the front 160 of the receptacle housing 120 to receive the circuit card 108. In an exemplary embodiment, the receptacle housing 120 includes a separating wall 184 that separates the mating receptacle 130 into different card slots 186. The first contact assembly 200*a* is positioned in the first card slot 186*a* and the second contact assembly 200*b* is positioned in the second card slot 186*b*.

Figure 18:
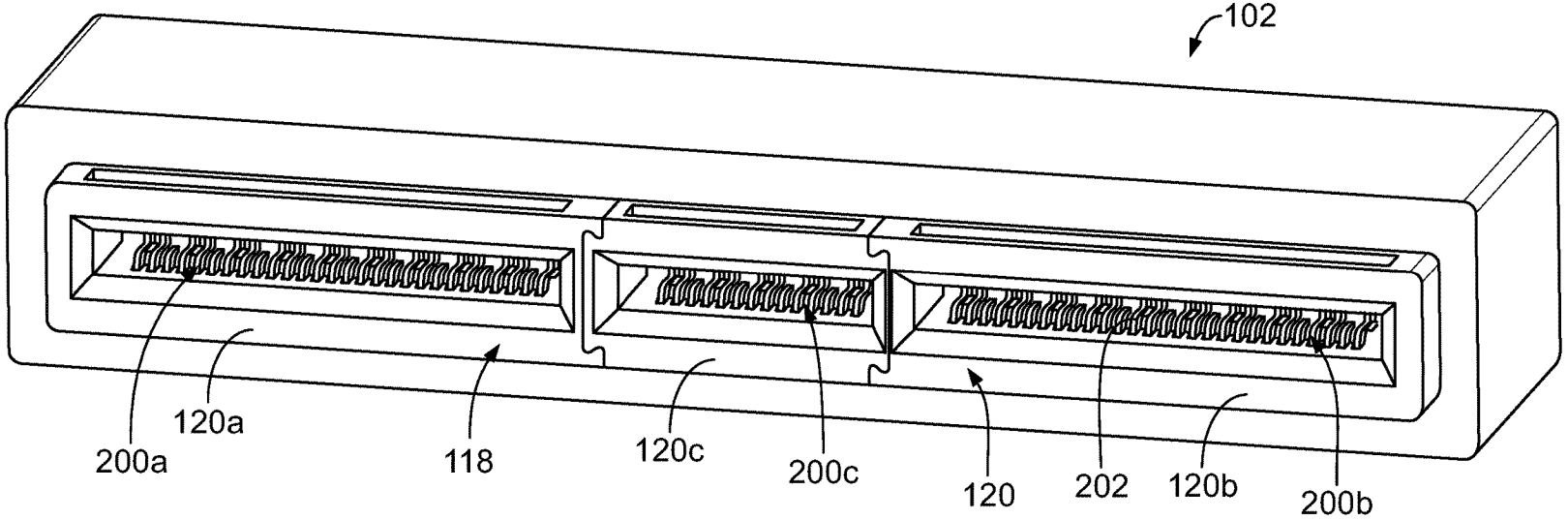
FIG. 18 is a front perspective view of the cable receptacle connector in accordance with an exemplary embodiment.
Figure 19:
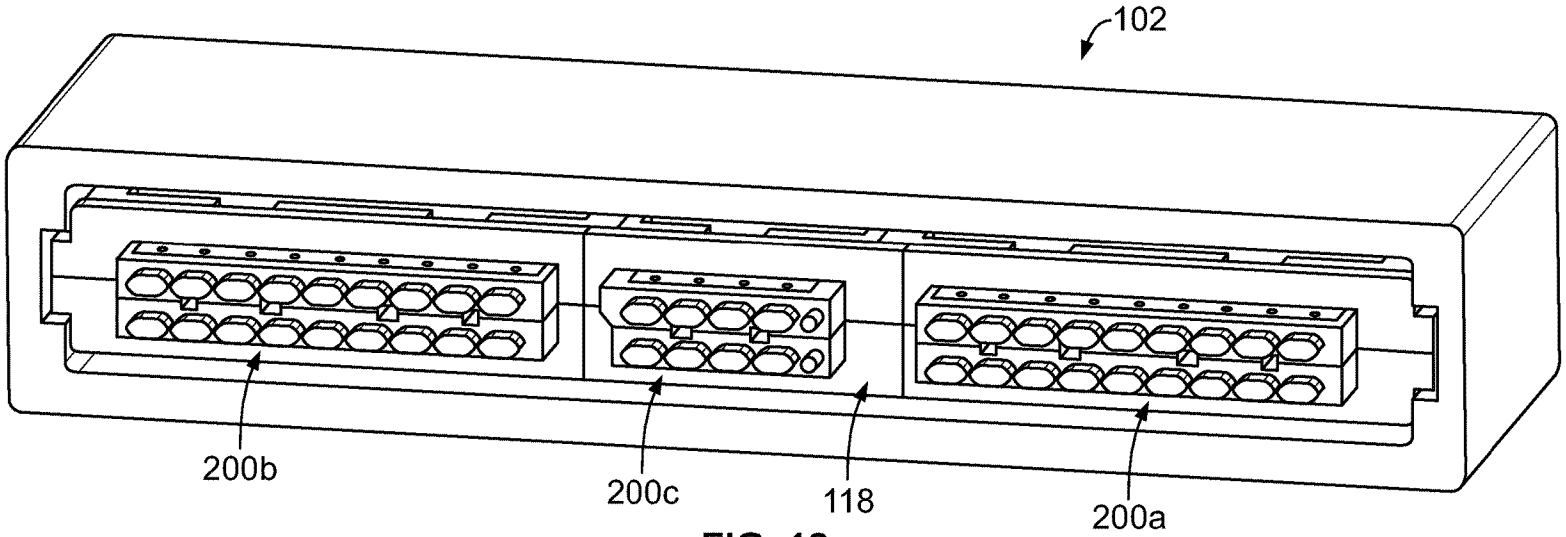
FIG. 19 is a rear perspective view of the cable receptacle connector in accordance with an exemplary embodiment.

FIG. 18 is a front perspective view of the cable receptacle connector 102 in accordance with an exemplary embodiment. FIG. 19 is a rear perspective view of the cable receptacle connector 102 in accordance with an exemplary embodiment. FIGS. 18 and 19 illustrates the receptacle assembly 118 including three contact assemblies 200*a*, 200*b*, 200*c* each received in a corresponding receptacle housing 120. As such, FIG. 18 illustrates three receptacle housings 120*a*, 120*b*, 120*c*. The first contact assembly 200*a* is a right side contact assembly 200*a*, the second contact assembly 200*b* is a left side contact assembly, and the third contact assembly 200*c* is a central contact assembly 200*c*. In the illustrated embodiment, the first contact assembly 200*a* is a 56 position contact assembly, the second contact assembly 200*b* is a 56 position contact assembly, and the third contact assembly 200*c* is a 28 position contact assembly. Other arrangements are possible in alternative embodiments to change the number of contact positions provided in the receptacle assembly 118. For example, the receptacle assembly 118 may be provided without the central contact assembly 200*c*, rather having the right side contact assembly 200*a* directly couple to the left side contact assembly 200*b* using corresponding mating features, such as dovetails. In other various embodiments, the central contact assembly 200*c* may be a wider contact assembly having a greater number of contacts 202, such as being a 56 position contact assembly or may have an even greater number of contacts 202. The contact assemblies 200 are modular in design to increase or decrease the number of contacts 202 depending on the particular application.

Figure 20:
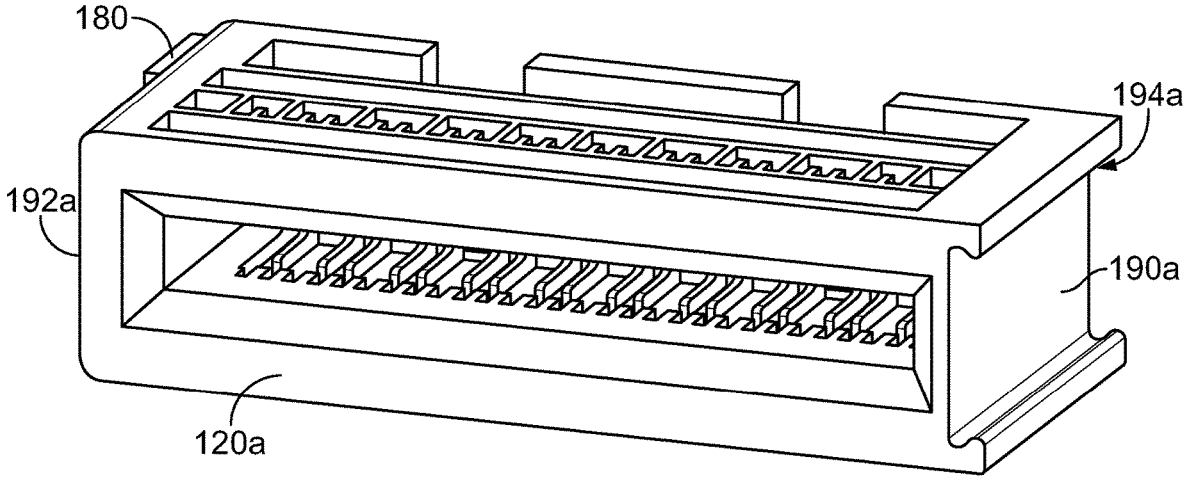
FIG. 20 is a front perspective view of the first receptacle housing in accordance with an exemplary embodiment.

FIG. 20 is a front perspective view of the first receptacle housing 120*a*. The first receptacle housing 120*a* includes an inner end 190*a* and an outer end 192*a* opposite the inner end 190*a*. The outer end 192*a* defines an outer end of the receptacle assembly (for example, no other receptacle housing is provided beyond the outer end 192*a*). The outer end

192*a* includes the locating tab 180. The inner end 190*a* is configured to face and couple to another receptacle housing. The inner end 190*a* includes a mating feature 194*a*. In the illustrated embodiment, the mating feature 194*a* is a slot, such as a dovetail slot. Other types of mating features may be provided in alternative embodiments, such as protrusions, tabs, latches, dovetails, or other mating features.

Figure 21:
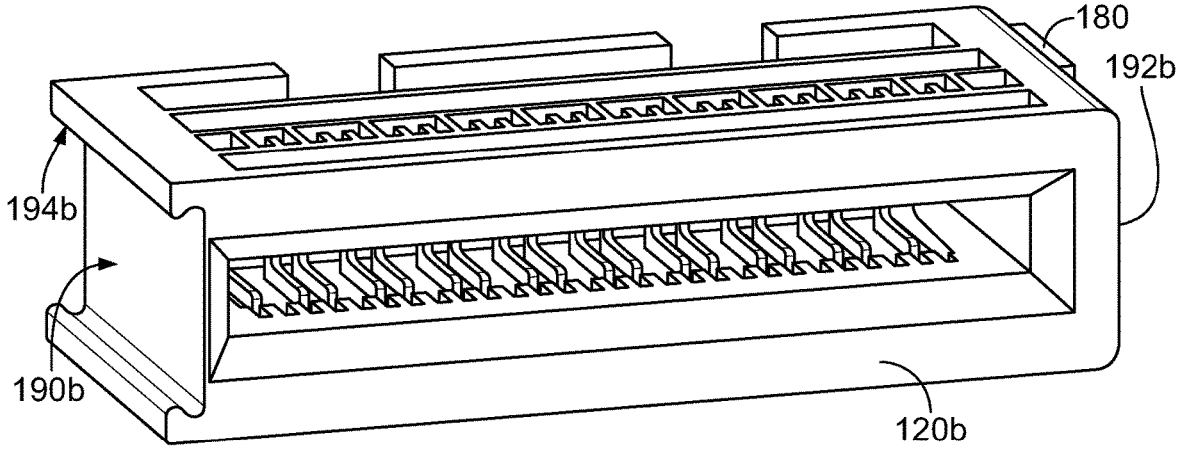
FIG. 21 is a front perspective view of the second receptacle housing in accordance with an exemplary embodiment.

FIG. 21 is a front perspective view of the second receptacle housing 120*b*. The second receptacle housing 120*b* includes an inner end 190*b* and an outer end 192*b* opposite the inner end 190*b*. The outer end 192*b* defines an outer end of the receptacle assembly (for example, no other receptacle housing is provided beyond the outer end 192*b*). The outer end 192*b* includes the locating tab 180. The inner end 190*b* is configured to face and couple to another receptacle housing. The inner end 190*b* includes a mating feature 194*b*. In the illustrated embodiment, the mating feature 194*b* is a slot, such as a dovetail slot. Other types of mating features may be provided in alternative embodiments, such as protrusions, tabs, latches, dovetails, or other mating features.

Figure 22:
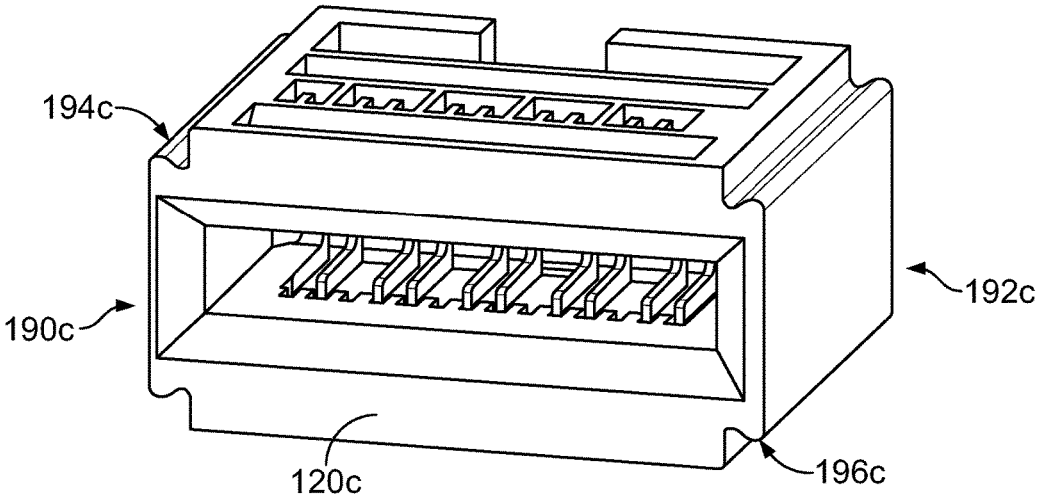
FIG. 22 is a front perspective view of the third receptacle housing in accordance with an exemplary embodiment.

FIG. 22 is a front perspective view of the third receptacle housing 120*c*. The third receptacle housing 120*c* includes ends 190*c*, 192*c* at right and left sides of the third receptacle housing 120*c*. The ends 190*c*, 192*c* define right and left ends configured to face and couple to other receptacle housings. The right and left ends 190*c*, 192*c* includes right and left mating features 194*c*, 196*c*, respectively. In the illustrated embodiment, the mating features 194*c*, 196*c* are dovetails. Other types of mating features may be provided in alternative embodiments, such as slots, dovetail slots, protrusions, tabs, latches, or other mating features. In various embodiments, the mating features 194*c*, 196*c* are identical, such as both being dovetails. However, in alternative embodiments, the mating features 194*c*, 196*c* may be different, such as a dovetail on one side and a dovetail slot on the other side.

Figure 23:
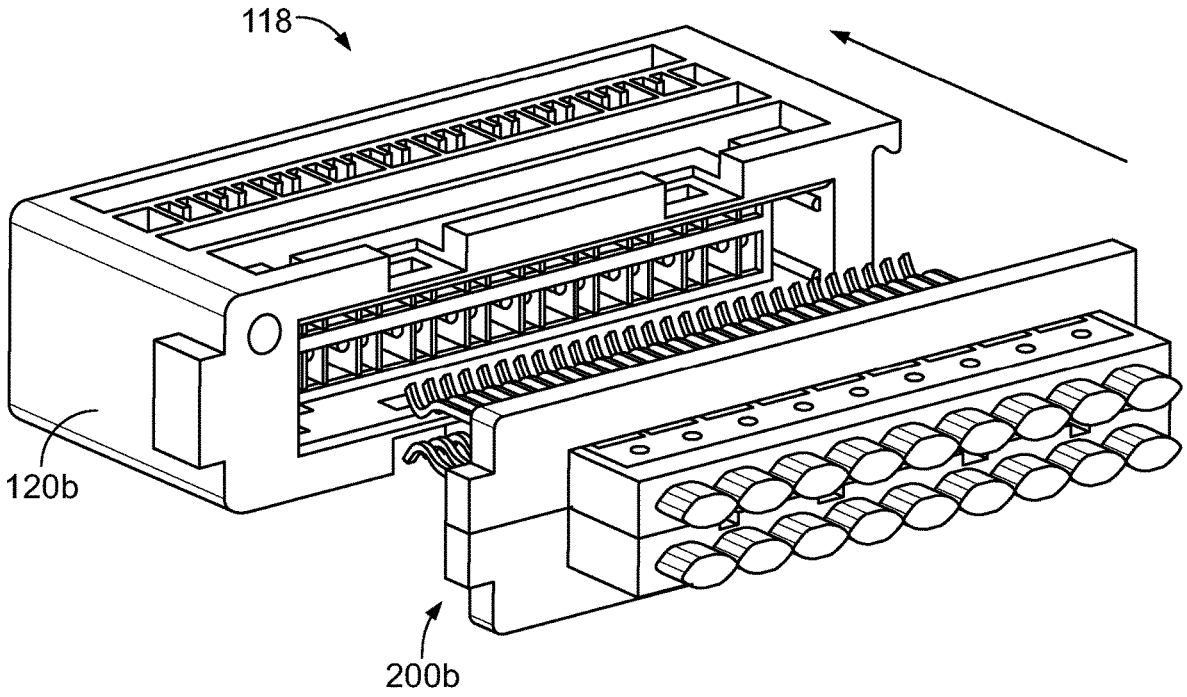
FIG. 23 is a rear perspective view of a portion of the receptacle assembly showing the left side subassembly including the second receptacle housing and the corresponding contact assembly in accordance with an exemplary embodiment.
Figure 24:
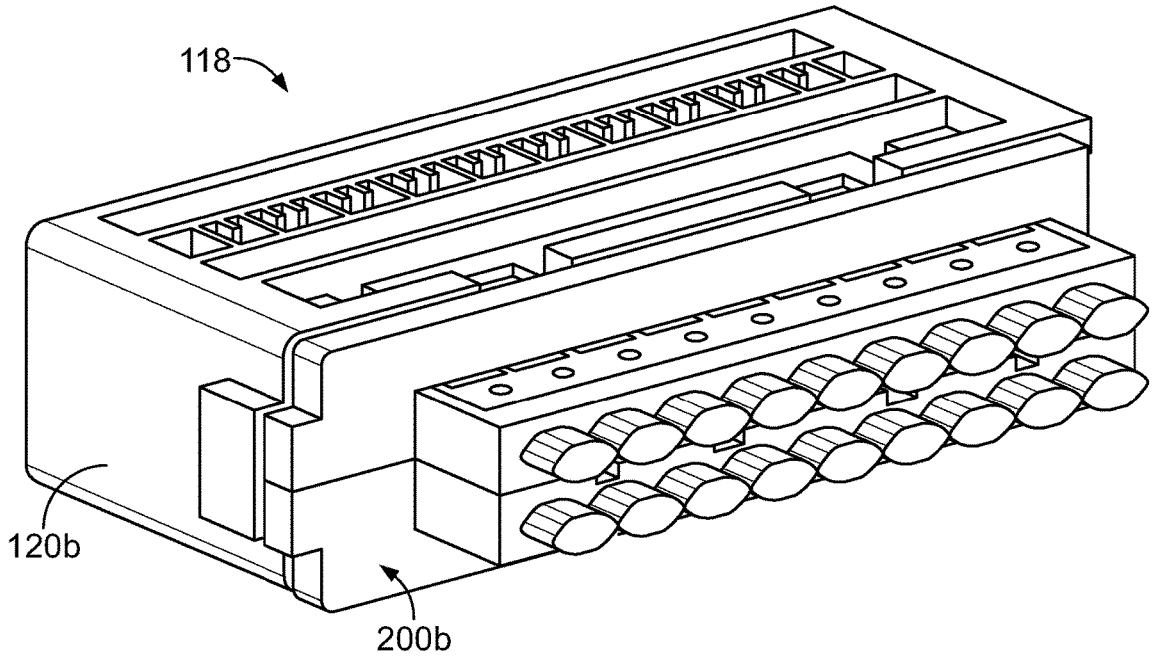
FIG. 24 is a rear perspective view of a portion of the receptacle assembly showing the left side subassembly including the second receptacle housing and the corresponding contact assembly in an assembled state in accordance with an exemplary embodiment.
Figure 25:
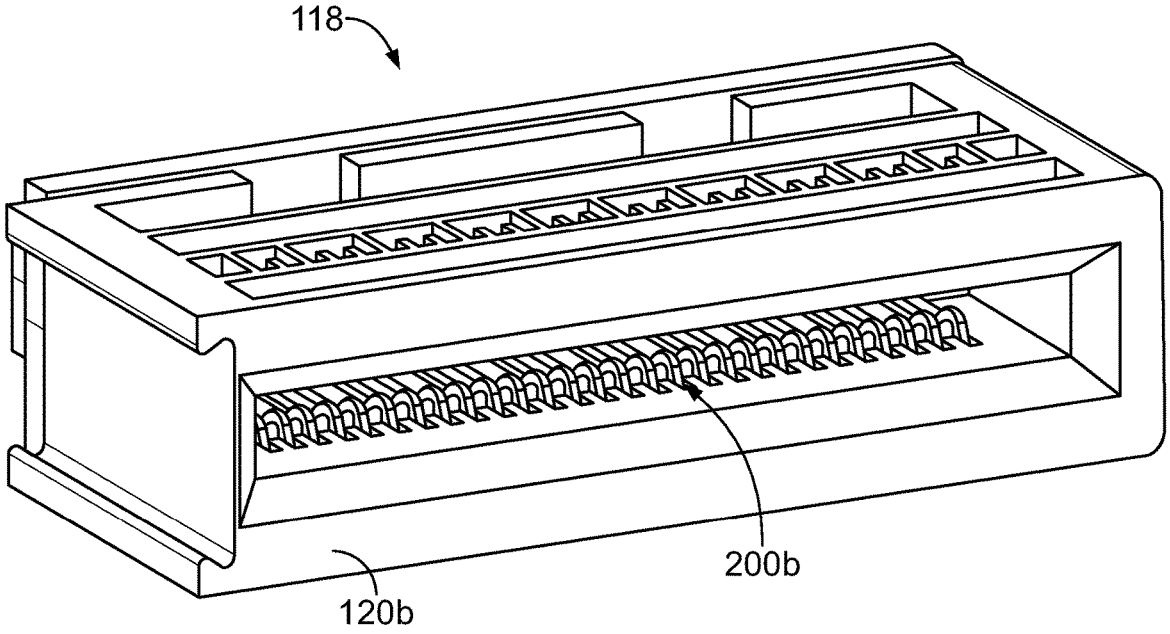
FIG. 25 is a front perspective view of a portion of the receptacle assembly showing the left side subassembly including the second receptacle housing and the corresponding contact assembly in an assembled state in accordance with an exemplary embodiment.

FIG. 23 is a rear perspective view of a portion of the receptacle assembly 118 showing the left side subassembly including the second receptacle housing 120*b* and the corresponding contact assembly 200*b*. FIG. 24 is a rear perspective view of a portion of the receptacle assembly 118 showing the left side subassembly including the second receptacle housing 120*b* and the corresponding contact assembly 200*b* in an assembled state. FIG. 25 is a front perspective view of a portion of the receptacle assembly 118 showing the left side subassembly including the second receptacle housing 120*b* and the corresponding contact assembly 200*b* in an assembled state.

Figure 26:
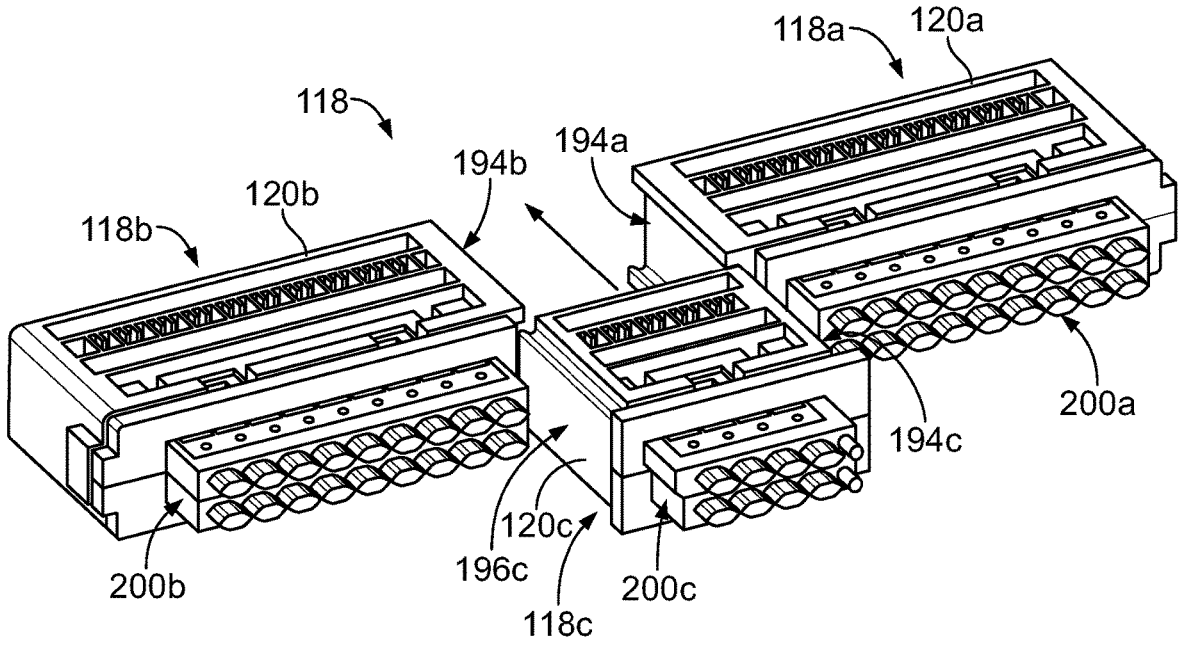
FIG. 26 is a rear perspective view of the receptacle assembly showing the central subassembly being mated with the right side subassembly and the left side subassembly in accordance with an exemplary embodiment.

FIG. 26 is a rear perspective view of the receptacle assembly 118 showing the central subassembly 118*c* being mated with the right side subassembly 118*a* and the left side subassembly 118*b*. The right side mating feature 194*c* is coupled to the mating feature 194*a*. The left side mating feature 196*c* is coupled to the mating feature 194*b*. When assembled, the receptacle housings 120*a*, 120*b*, 120*c* are joined together to form a unitary housing structure for the receptacle assembly 118. The receptacle housings 120*a*, 120*b*, 120*c* hold the corresponding contact assemblies 200*a*, 200*b*, 200*c*.

The subassembly 118*a*, 118*b*, 118*c* are modular in design to increase or decrease the number of contacts 202 depending on the particular application. For example, the receptacle assembly 118 may include additional subassemblies or subassemblies having a greater number of contacts 202 to increase the total number of contacts 202. In other various embodiments, the receptacle assembly 118 may be provided without the central subassembly 118*c* to reduce the number of contacts 202. In other various embodiments, the receptacle assembly 118 may be provided without the right side subassembly 118*a* or the left side subassembly 118*b* to reduce the number of contacts 202. The receptacle housings 120*a*, 120*b*, 120*c* may include appropriate mating features for coupling to other subassemblies and appropriate locating features at the right and left sides for loading into the shroud 124.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly comprising:

a signal leadframe including a plurality of signal contacts, each signal contact extending between a mating end and a terminating end, the mating end configured to be mated with a mating signal contact, the terminating end configured to be electrically connected to a cable;

a ground leadframe separate and discrete from the signal leadframe, the ground leadframe including a plurality of ground contacts, each ground contact extending between a mating end and a terminating end, the mating end configured to be mated with a mating ground contact, the terminating end configured to be electrically connected to a cable, each ground contact including a central transition section between the mating end and the terminating end, the central transition section extending out of plane relative to the signal leadframe, the central transition section being remote from the mating end and being remote from the terminating end, the ground leadframe including a ground tie bar extending between each of the central transition sections to electrically connect each of the ground contacts at each of the central transition sections, the ground tie bar positioned out of plane relative to the signal leadframe with the central transition sections to extend across the signal contacts; and a front contact holder holding the signal contacts of the signal leadframe and holding the ground contacts of the ground leadframe, the front contact holder surrounding the central transition sections of the ground contacts, the front contact holder electrically isolates the ground tie bar from the signal contacts.

2. The contact assembly of claim 1, wherein the ground tie bar is stamped and formed integral with the ground contacts.

3. The contact assembly of claim 1, wherein the central transition sections are approximately centered between the mating ends and the terminating ends of the ground contacts.

4. The contact assembly of claim 1, wherein the ground lead frame includes a ground bar extending between the terminating ends of the ground contacts to electrically connect each of the ground contacts, the mating ends of each of the ground contacts including mating tips electrically connected to the mating ground contacts, the mating tips defining front ground interfaces for the ground contacts, the ground bar defining rear ground interfaces for the ground contacts, the ground tie bar being approximately centered between the front ground interfaces and the rear ground interfaces.

5. The contact assembly of claim 1, wherein the ground lead frame is internested with the signal lead frame such that the ground contacts are located between pairs of the signal contacts.

6. The contact assembly of claim 1, wherein the terminating ends of the signal contacts include solder tabs configured to be soldered to signal conductors of the cables.

7. The contact assembly of claim 1, wherein the ground contacts are continuous from the mating ends to the terminating ends through the central transition sections, the ground tie bars being continuous with each of the central transition sections.

8. The contact assembly of claim 1, further comprising a rear contact holder separate and discrete from the front contact holder, the rear contact holder located rearward of the front contact holder, the rear contact holder being overmolded around the terminating ends of each of the signal contacts and around the terminating ends of each of the ground contacts, the rear contact holder configured to provide strain relief for the cables.

9. A cable receptacle connector comprising:

a receptacle housing extending between a front and a rear, the receptacle housing having a mating receptacle at the front configured to receive a mating connector, the receptacle housing including a rear cavity at the rear, the receptacle housing including a base wall between the front and the rear having contact channels, the contact channels being open to the mating receptacle; and a contact assembly received in the receptacle housing, the contact assembly including an upper contact sub-assembly and a lower contact sub-assembly coupled to the upper contact sub-assembly, the contact assembly including upper cables electrically connected to the upper contact sub-assembly and lower cables electrically connected to the lower contact sub-assembly;

the upper contact sub-assembly comprising an upper signal leadframe, an upper ground leadframe and an upper contact holder, the upper signal leadframe including a plurality of upper signal contacts each extending between a mating end configured to be mated with an upper mating signal contact of the mating connector and a terminating end electrically connected to the corresponding upper cable, the upper ground leadframe including a plurality of upper ground contacts each extending between a mating end configured to be mated with an upper mating ground contact of the mating connector and a terminating end electrically connected to the corresponding upper cable, each upper ground contact including a central transition section approximately centered between the mating end and the terminating end, the central transition section extending out of plane relative to the upper signal leadframe, the upper ground leadframe including an upper ground tie bar extending between each of the central transition sections to electrically connect each of the upper ground contacts, the upper ground tie bar positioned out of plane relative to the upper signal leadframe with the central transition sections to extend across the upper signal contacts, the upper contact holder holding the upper signal contacts and the upper ground contacts, the upper contact holder surrounding the central transition sections of the upper ground contacts and electrically isolating the upper ground tie bar from the upper signal contacts; and the lower contact sub-assembly comprising a lower signal leadframe, a lower ground leadframe and a lower contact holder, the lower signal leadframe including a plurality of lower signal contacts each extending between a mating end configured to be mated with a lower mating signal contact of the mating connector and a terminating end electrically connected to the corresponding lower cable, the lower ground leadframe including a plurality of lower ground contacts each extending between a mating end configured to be mated with a lower mating ground contact of the mating connector and a terminating end electrically connected to the corresponding lower cable, each lower ground contact including a central transition section approximately centered between the mating end and the terminating end, the central transition section extending out of plane relative to the lower signal leadframe, the lower ground leadframe including a lower ground tie bar extending between each of the central transition sections to electrically connect each of the lower ground contacts, the upper ground tie bar positioned out of plane relative to the lower signal leadframe with the central transition sections to extend across the upper signal contacts, the upper contact holder holding the lower signal contacts and the lower ground contacts, the upper contact holder surrounding the central transition sections of the lower ground contacts and electrically isolating the lower ground tie bar from the lower signal contacts;

wherein the lower contact holder is coupled to the upper contact holder to position the lower signal contacts and the lower ground contacts relative to the upper signal contacts and the upper ground contacts.

10. The cable receptacle connector of claim 9, wherein the upper contact holder includes an upper front contact holder and an upper rear contact holder separate and discrete from the upper front contact holder, the upper front contact holder being overmolded around the central transition sections of the upper ground contacts, the upper rear contact holder being overmolded around the terminating ends of the upper signal contacts and the terminating ends of the upper ground contacts, the upper rear contact holder being overmolded around the upper cables, and wherein the lower contact holder includes an lower front contact holder and an lower rear contact holder separate and discrete from the lower front contact holder, the lower front contact holder being overmolded around the central transition sections of the lower ground contacts, the lower rear contact holder being overmolded around the terminating ends of the lower signal contacts and the terminating ends of the lower ground contacts, the lower rear contact holder being overmolded around the lower cables.

11. The cable receptacle connector of claim 9, wherein the upper contact holder includes an upper flange engaging the rear of the receptacle housing and the lower contact holder includes a lower flange engaging the rear of the receptacle housing.

12. The cable receptacle connector of claim 9, wherein the mating receptacle includes a card slot, the mating ends of the upper signal contacts being located along a top of the card slot and the mating ends of the lower signal contacts being located along a bottom of the card slot.

13. The cable receptacle connector of claim 9, further comprising a second contact assembly received in the receptacle housing adjacent the contact assembly.

14. The cable receptacle connector of claim 9, wherein the receptacle housing includes a mating feature along a first side of the receptacle housing, the mating feature configured to engage a mating feature of a second receptacle housing.

15. The cable receptacle connector of claim 9, wherein the receptacle housing includes a keying feature, the cable receptacle connector further comprising a shroud having a chamber receiving the receptacle housing, the keying feature engaging the shroud to locate the receptacle housing in the chamber of the shroud.

16. The cable receptacle connector of claim 9, wherein the upper ground lead frame includes an upper ground bar extending between the terminating ends of the upper ground contacts to electrically connect each of the upper ground contacts, the upper ground tie bar being approximately centered between mating tips of the upper ground contacts and the upper ground bar, wherein the lower ground lead frame includes an lower ground bar extending between the terminating ends of the lower ground contacts to electrically connect each of the lower ground contacts, the lower ground tie bar being approximately centered between mating tips of the lower ground contacts and the lower ground bar.

17. A cable receptacle connector comprising:

a shroud having a chamber, the shroud extending between a front and a rear, the shroud having a right side and a left side between the front and the rear;

a receptacle assembly received in the chamber of the shroud, the receptacle assembly including a right side sub-assembly in the chamber at the right side of the shroud and a left side sub-assembly in the chamber at the left side of the shroud;

the right side sub-assembly including a first receptacle housing and a first contact assembly received in the first receptacle housing, the first receptacle housing having a first mating receptacle at a front and a first base wall rearward of the first mating receptacle having first contact channels open to the first mating receptacle, the right side sub-assembly including first cables electrically connected to the first contact assembly, the first contact assembly including a first signal leadframe, a first ground leadframe and a first contact holder coupled to the first signal leadframe and the first ground leadframe, the first signal leadframe including a plurality of first signal contacts each extending between a mating end and a terminating end electrically connected to the corresponding first cable, the first ground leadframe including a plurality of first ground contacts each extending between a mating end and a terminating end, the first ground leadframe including a first ground tie bar extending between each of the first ground contacts, the first ground tie bar positioned out of plane relative to the first signal leadframe to extend across the first signal contacts, the first contact holder holding the first signal contacts and the first ground contacts; and the left side sub-assembly including a second receptacle housing and a second contact assembly received in the second receptacle housing, the second receptacle housing having a second mating receptacle at a front and a second base wall rearward of the second mating receptacle having second contact channels open to the second mating receptacle, the left side sub-assembly including second cables electrically connected to the second contact assembly, the second contact assembly including a second signal leadframe, a second ground leadframe and a second contact holder coupled to the second signal leadframe and the second ground leadframe, the second signal leadframe including a plurality of second signal contacts each extending between a mating end and a terminating end electrically connected to the corresponding second cable, the second ground leadframe including a plurality of second ground contacts each extending between a mating end and a terminating end, the second ground leadframe including a second ground tie bar extending between each of the second ground contacts, the second ground tie bar positioned out of plane relative to the second signal leadframe to extend across the second signal contacts, the second contact holder holding the second signal contacts and the second ground contacts;

wherein the first receptacle housing includes an inner end and an outer end opposite the inner end, the outer end including a keying tab extending therefrom configured to engage the right side of the shroud to locate the first receptacle housing in the chamber, and wherein the second receptacle housing includes an inner end and an outer end opposite the inner end, the outer end including a keying tab extending therefrom configured to engage the left side of the shroud to locate the second receptacle housing in the chamber.

18. The cable receptacle connector of claim 17, wherein each of the first ground contacts includes a first central transition section approximately centered between the mating ends and the terminating ends, the first central transition section extending out of plane relative to the first signal leadframe, the first ground tie bar positioned out of plane relative to the first signal leadframe with the first central transition sections to extend across the signal contacts extending between each of the first central transition sections to electrically connect each of the first ground contacts, the first contact holder encasing the first central transition sections, and wherein each of the second ground contacts includes a second central transition section approximately centered between the mating ends and the terminating ends, the second central transition section extending out of plane relative to the second signal leadframe, the second ground tie bar positioned out of plane relative to the second signal leadframe with the second central transition sections to extend between each of the second central transition sections to electrically connect each of the second ground contacts, the second contact holder encasing the second central transition sections.

19. The cable receptacle connector of claim 17, wherein the first receptacle housing includes a first mating feature at the inner end of the first receptacle housing and the second receptacle housing includes a second mating feature at the inner end of the second receptacle housing.

20. The cable receptacle connector of claim 19, wherein the first mating feature engages the second mating feature.

21. The cable receptacle connector of claim 19, wherein the receptacle assembly further comprises a central subassembly located between the right side subassembly and the left side subassembly, the central subassembly including a third receptacle housing and a third contact assembly, the third receptacle housing including a right side mating feature at a right side of the third receptacle housing engaging the first mating feature, the third receptacle housing including a left side mating feature at a left side of the third receptacle housing engaging the second mating feature.

22. The cable receptacle connector of claim 17, wherein the first signal lead frame includes a greater amount of the first signal contacts compared to the second signal contacts of the second signal lead frame.

23. The cable receptacle connector of claim 17, wherein the right side subassembly is identical to the left side subassembly, the right side subassembly being inverted 180° relative to the left side subassembly in the chamber.

* * * * *